US009666125B2

(12) United States Patent
Chung

(10) Patent No.: US 9,666,125 B2
(45) Date of Patent: May 30, 2017

(54) ORGANIC LIGHT-EMITTING DIODE CIRCUIT AND DRIVING METHOD THEREOF

(71) Applicant: AU OPTRONICS CORP., Hsinchu (TW)

(72) Inventor: Chieh-Hsing Chung, Hsin-Chu (TW)

(73) Assignee: AU OPTRONICS CORP., Hsinchu (TW)

( * ) Notice: Subject to any disclaimer, the term of this patent is extended or adjusted under 35 U.S.C. 154(b) by 163 days.

(21) Appl. No.: 14/509,308

(22) Filed: Oct. 8, 2014

(65) Prior Publication Data

US 2015/0154906 A1 Jun. 4, 2015

(30) Foreign Application Priority Data

Dec. 4, 2013 (TW) ..... 102144416 A

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0819* (2013.01); *G09G 2300/0842* (2013.01); *G09G 2300/0852* (2013.01); *G09G 2310/0202* (2013.01); *G09G 2320/0233* (2013.01)

(58) Field of Classification Search
CPC ..... G09G 3/32; G09G 2300/0413; G09G 2300/0439; G09G 2300/0443; G09G 2300/0447; G09G 2300/0452; G09G 2300/0456; G09G 2300/046; G09G 2300/0465; G09G 2300/0469; G09G 2300/0473; G09G 2300/0478; G09G 2300/0482; G09G 2300/04; G09G 2300/0421; G09G 2300/0426; G09G 2300/043; G09G 2310/0264; G09G 2310/027; G09G 2310/0272; G09G 2310/0275; G09G 2310/0278; G09G 2320/00; G09G 2320/02; G09G 2320/0204; G09G 2320/0228; G09G 2320/0233;
(Continued)

(56) References Cited

U.S. PATENT DOCUMENTS 8,963,907 B2 * 2/2015 Tsai ..... G09G 3/14 345/212
9,337,439 B2 * 5/2016 Kwon ..... G09G 3/3258
(Continued)

*Primary Examiner* — Grant Sitta
(74) *Attorney, Agent, or Firm* — WPAT, PC; Justin King

(57) ABSTRACT

An organic light-emitting diode circuit and a driving method thereof are disclosed herein. The organic light-emitting diode circuit includes a storage unit, a transistor, a coupling capacitor, a compensation unit, an input unit, a switch unit, and an organic light-emitting diode. The transistor is configured to be driven by a voltage stored in the storage unit so that a second end of the transistor generates a driving current. The coupling capacitor changes a voltage of the second end of the transistor. The compensation unit changes the voltage level at the second end of the transistor according to a first scan signal. The input unit transmits a data voltage to the storage unit according to a second scan signal. The switch unit is turned on according to a light-emitting signal so that the driving current is transmitted to the organic light-emitting diode through the switch unit.

20 Claims, 13 Drawing Sheets

(58) Field of Classification Search
CPC ..... G09G 2330/02; G09G 2330/021; G09G 2330/022; G09G 2330/023; G09G 2330/024
USPC ..... 345/76, 205, 204, 212
See application file for complete search history.

(56) References Cited

U.S. PATENT DOCUMENTS

2005/0104815 A1* 5/2005 Komiya ..... G09G 3/3233 345/76
2005/0156829 A1 7/2005 Choi et al.
2006/0007070 A1 1/2006 Shih
2006/0066532 A1* 3/2006 Jeong ..... G09G 3/3233 345/76
2007/0024541 A1* 2/2007 Ryu ..... G09G 3/3233 345/76
2007/0030217 A1 2/2007 Peng
2010/0045654 A1* 2/2010 Yamashita ..... G09G 3/3233 345/213
2010/0201674 A1* 8/2010 Kim ..... G09G 3/3233 345/211
2011/0164018 A1* 7/2011 Kang ..... G09G 3/3233 345/211
2011/0193850 A1* 8/2011 Chung ..... G09G 3/3233 345/212
2012/0113085 A1* 5/2012 Kawabe ..... G09G 3/3233 345/212
2012/0120042 A1 5/2012 Tsai et al.
2012/0218252 A1* 8/2012 Yamauchi ..... G09G 3/36 345/212
2013/0027380 A1* 1/2013 Wang ..... G09G 3/3233 345/212
2014/0022150 A1* 1/2014 Guo ..... G09G 3/3233 345/76
2014/0049169 A1* 2/2014 Li ..... H05B 33/0896 315/173

* cited by examiner

ORGANIC LIGHT-EMITTING DIODE CIRCUIT AND DRIVING METHOD THEREOF

RELATED APPLICATIONS

This application claims priority to Taiwan Application Serial Number 102144416, filed Dec. 4, 2013, which is herein incorporated by reference.

BACKGROUND

Field of Invention

The present disclosure relates to an organic light-emitting diode circuit and a driving method thereof. More particularly, the present disclosure relates to an organic light-emitting diode circuit with a compensation function and a driving method thereof.

Description of Related Art

A flat panel display has been widely used in daily life with the development of the display technology. An organic light-emitting diode (OLED) display is one of the most popular flat panel displays for its features of high definition, high contrast characteristics, and high reaction speed.

Generally, the organic light-emitting diode display includes a data driving unit, a scan driving unit and a plurality of display units. Each of the plurality of display units includes an organic light-emitting diode circuit, and the organic light-emitting diode circuit includes a plurality of transistors.

The threshold voltage (Vth) of each of the plurality of transistors may differ due to the process variation in the production of the plurality of transistors, so that the resulting driving currents of the plurality of transistors under the operations may vary accordingly. When the driving currents are different, it leads to inconsistent brightness between the organic light-emitting diodes and causes the mura (non-uniformity of luminance) issue when the display exhibits images.

SUMMARY

An aspect of the present disclosure is an organic light-emitting diode circuit. According to an exemplary embodiment of the present disclosure, the organic light-emitting diode circuit includes a storage unit, a first transistor, a coupling capacitor, a compensation unit, an input unit, a switch unit and an organic light-emitting diode. The first transistor has a first end, a second end, and a control end. The control end of the first transistor is electrically coupled to the storage unit. The first transistor is configured to be driven by a voltage stored in the storage unit to generate a driving current from the second end of the first transistor. The coupling capacitor has a first end electrically coupled to the second end of the first transistor, and a second end, the coupling capacitor is configured to change a voltage of the second end of the first transistor from a first voltage level to a second voltage level according to a voltage variation of the second end of the coupling capacitor and the first voltage level of the second end of the first transistor. The compensation unit is electrically coupled to the second end of the first transistor and the storage unit. The compensation unit is configured to change the voltage of the second end of the first transistor from the second voltage level to a third voltage level according to a current path, wherein the current path connects the first transistor and the compensation unit in series, and the current path is activated by a first scan signal. The input unit is configured to transmit a data voltage to the storage unit according to a second scan signal. The organic light-emitting diode is configured to receive the driving current. The switch unit is configured to be turned on according to a light-emitting signal so that the driving current is transmitted to the organic light-emitting diode through the switch unit.

An aspect of the present disclosure is driving method of an organic light-emitting diode circuit. According to an exemplary embodiment of the present disclosure, the driving method of the organic light-emitting diode is applied to an organic light-emitting diode circuit and includes a storage unit which has a first capacitor and a second capacitor electrically coupled to each other, a first transistor is electrically coupled to the storage unit, a coupling capacitor is electrically coupled to the first transistor, a compensation unit is electrically coupled to the first transistor and the coupling capacitor, an input unit electrically coupled to the first capacitor and the second capacitor, and an organic light-emitting diode is electrically coupled to the second capacitor. The driving method includes: during a second period, driving a first reset unit and the compensation unit with a first scan signal, providing a reference voltage to a first end of the first capacitor, and driving the compensation unit with the first scan signal to conduct a second end of the first transistor to a second end of the first capacitor, and changing a voltage level at the second end of the first transistor from a first voltage level to a second voltage level according to a voltage variation of the second end of the coupling capacitor and the first voltage level of the second end of the first transistor, and changing the voltage level at the second end of the first transistor from the second voltage level to a third voltage level via a current path, wherein the current path connects the first transistor and the compensation unit in series, and the current path is activated by the first scan signal; during a third period, driving the input unit by a second scan signal for providing a data voltage to a first end of the second capacitor, and driving the second reset unit with a second scan signal to provide the reference voltage to a second end of the second capacitor; and during a fourth period, driving a switch unit by a light-emitting signal so that a driving current generated by the first transistor flows into the organic light-emitting diode through the switch unit.

An aspect of the present disclosure is an organic light-emitting diode circuit. According to an exemplary embodiment of the present disclosure, the organic light-emitting diode circuit includes a storage unit, a first transistor, a coupling capacitor, an input unit and an organic light-emitting diode. The first transistor is electrically coupled to the first capacitor and configured to be driven by the voltage stored in the storage unit to generate a driving current from a second end of the first transistor. The coupling unit is electrically coupled to the first transistor and configured to change a voltage of the second end of the first transistor from a first voltage level to a second voltage level according to a voltage variation of a control signal and the second end of the first transistor. The input unit is configured to transmit a data voltage to the storage unit according to a second scan signal. The organic light-emitting diode is configured to receive the driving current.

An aspect of the present disclosure is a driving method of an organic light-emitting diode circuit. According to an embodiment of the present disclosure, the driving method of the organic light-emitting diode circuit is applied to an organic light-emitting diode circuit and includes a storage unit which has a first capacitor, a first transistor is electrically coupled to the first capacitor, a coupling unit is electrically coupled to the first transistor, an input unit is electrically coupled to the first transistor and an organic light-emitting diode which is configured to receive a driving current provided by the first transistor. The driving method includes: charging the coupling unit with a control signal to control a voltage of a second end of the first transistor during a first period; driving a first reset unit with a first scan signal to provide a reference voltage to a first end of the first capacitor during a second period; driving the input unit with a second scan signal to provide a data voltage to the first end of the first capacitor during a third period; driving the input unit with the second scan signal to provide the data voltage with a high voltage level to the first end of the first capacitor during a fourth period; driving a switch unit with a light-emitting signal to make the driving current flow into the organic light-emitting diode through the switch unit during a fifth period.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
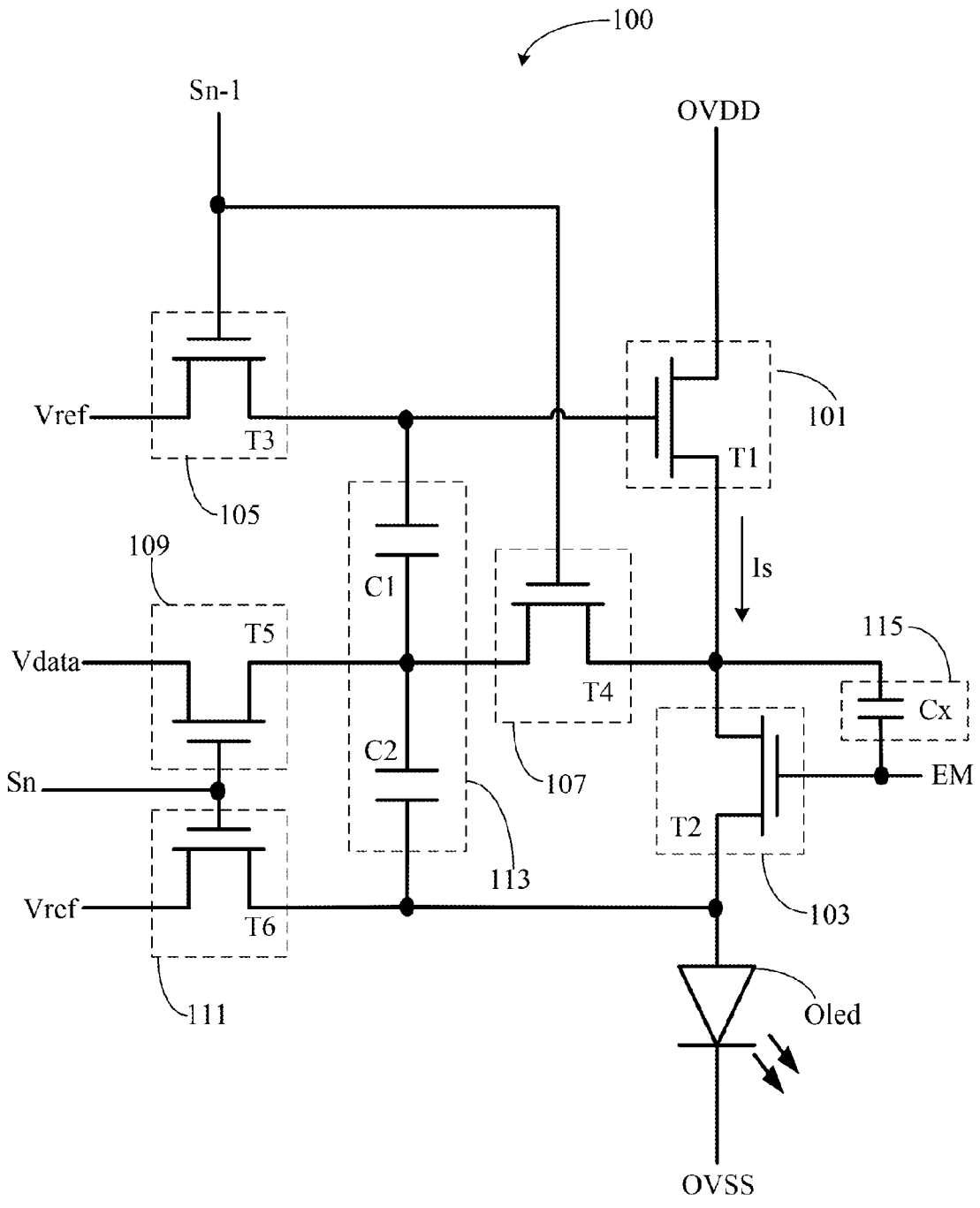
FIG. 1A is a diagram illustrating an exemplary embodiment of the organic light-emitting diode circuit of the present disclosure.

Reference will now be made in detail to the present embodiments of the disclosure, examples of which are illustrated in the accompanying drawings. Wherever possible, the same reference numbers are used in the drawings and the description to refer to the same or like parts.

Certain terms are used throughout the following description and claims, which refer to particular components. As one skilled in the art will appreciate, electronic equipment manufacturers may refer to a component by different names. This document does not intend to distinguish between components that differ in name but not in function. In the following description and in the claims, the terms "include" and "comprise" are used in an open-ended fashion, and thus should be interpreted to mean "include, but not limited to . . . ." Also, the term "couple" is intended to mean either an indirect or direct electrical connection. Accordingly, if one device is coupled to another device, that connection may be through a direct electrical connection, or through an indirect electrical connection via other devices and connections. In the following exemplary embodiments and the accompanying drawings, the components that are not related to the present disclosure have been omitted from the drawings, and are drawn in the size ratio between the elements in the drawings are only use for the understanding, and not meant to limit the actual embodiments of the present disclosure in scale.

The terms "first", "second" . . . etc., in the disclosure do not refer to any specific order, or intended to limit the present disclosure, it is only used for distinguishing the differences between components or operations with the same technological descriptions.

According to an embodiment of the present disclosure, an organic light-emitting diode circuit 100 is disclosed. FIG. 1A is a diagram illustrating an embodiment of the organic light-emitting diode circuit of the present disclosure. In practical applications, the organic light-emitting diode circuit 100 can be applied into an organic light-emitting diode (OLED) display. For instance, it can be an organic light-emitting diode pixel circuit within the OLED display, wherein the OLED display may include a data driving unit, a scan driving unit, signal line(s), scan line(s) and a plurality of display units arranged in a matrix formation.

When the scan driving unit turns on each row of the organic light-emitting diode circuit 100 via the scan lines, the data scan unit also writes the data signals into each row of the organic light-emitting diode circuit 100 via the scan lines so that the organic light-emitting diodes emit light.

As shown in FIG. 1A, the organic light-emitting diode circuit 100 comprises an organic light-emitting diode Oled, a driving unit 101, a switch unit 103, a reset unit 105, a compensation unit 107, an input unit 109, a reset unit 111, a storage unit 113 and a coupling unit 115.

In this embodiment, the driving unit 101 includes a transistor T1. The switch unit 103 includes a transistor T2. The reset unit 105 includes a transistor T3. The compensation unit 107 includes a transistor T4. The input unit 109 includes a transistor T5. The reset unit 111 includes a transistor T6. In addition, each of the transistors T1-T6 includes a first end (e.g., drain), a second end (e.g., source), and a control end (e.g., gate), and the transistors T1-T6 can be P type transistors or N type transistors.

In structure, the first end of the transistor T1 is electrically coupled to the voltage source OVDD, and the control end of the transistor T1 is electrically coupled to the storage unit 113. The transistor T1 is driven by a voltage stored in the storage unit 113 to provide a driving current Is from the second end of the transistor T1. The storage unit 113 includes a capacitor C1 and a capacitor C2, and each of the capacitor C1 and the capacitor C2 has a first end and a second end, respectively. The first end of the capacitor C1 is electrically coupled to the control end of the transistor T1, the second end of the capacitor C1 is electrically coupled to the first end of the capacitor C2 and the second end of the capacitor C2 is electrically coupled to the second end of the transistor T2.

As shown in FIG. 1A, the control end of the transistor T1 is electrically coupled to the first end of the capacitor C1, and the second end of the transistor T1 is electrically coupled to the first end of the transistor T2. In addition, the second end of the transistor T2 is electrically coupled to an anode of the organic light-emitting diode Oled, and a cathode of the organic light-emitting diode Oled is electrically coupled to the voltage source OVSS. The transistor T2 is turned on according to a light-emitting signal EM so that the driving current Is is transmitted to the organic light-emitting diode Oled through the transistor T2, then the organic light-emitting diode Oled receives the driving current Is, and thereby radiating according to the driving current Is.

In this embodiment, the coupling unit 115 includes a coupling capacitor Cx, and the coupling capacitor Cx has a first end and a second end. The first end of the coupling capacitor Cx is electrically coupled to the first end of the transistor T2, and the second end of coupling capacitor Cx is electrically coupled to the control end of the transistor T2. The coupling capacitor Cx can be, for instance, a parasitic capacitor between the gate and the drain of the transistor T2.

As shown in FIG. 1A, the first end of the transistor T3 is electrically coupled to the reference voltage Vref, the second end of the transistor T3 is electrically coupled to the first end of the capacitor C1 and the control end of the transistor T1. The first end of the transistor T4 is electrically coupled to the second end of the capacitor C1 and the first end of the capacitor C2, and the second end of the transistor T4 is electrically coupled to the second end of the transistor T1, the first end of the transistor T2 and the first end of the coupling capacitor Cx. Furthermore, the control end of the transistor T3 and the control end of the transistor T4 are configured to receive a scan signal Sn-1.

In this embodiment, the first end of the transistor T5 is electrically coupled to the data voltage Vdata, and the second end of the transistor T5 is electrically coupled to the second end of the capacitor C1 and the first end of the capacitor C2. Moreover, the first end of the transistor T6 is electrically coupled to the reference voltage Vref, and the second end of the transistor T6 is electrically coupled to the second end of the capacitor C2 and the second end of the transistor T2. In addition, the control end of the transistor T5 and the control end of the transistor T6 are configured to receive a scan signal Sn.

Figure 1B:
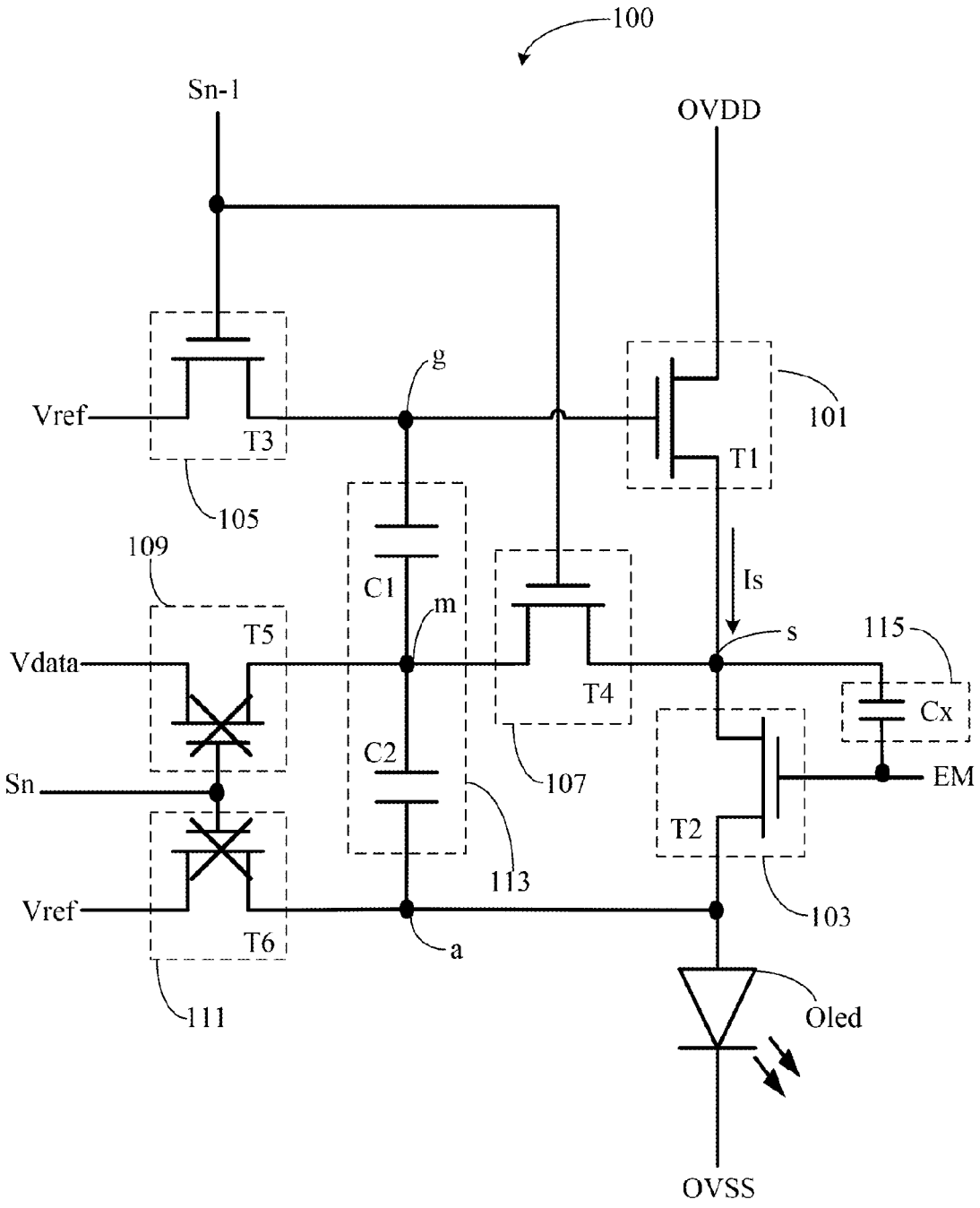
FIG. 1B-1E are operational diagrams of an operational period according to the organic light-emitting diode circuit of FIG. 1A.

On the operations, Reference is made to FIG. 1B. FIG. 1B is an operational diagram of an operational period (e.g., a reset period) according to the organic light-emitting diode circuit 100 shown in FIG. 1A. Reference is made to FIG. 1B in conjunction with FIG. 1F. FIG. 1F is an operational timing sequences of the organic light-emitting diode circuit 100 illustrated shown in FIG. 1B.

As shown in FIG. 1B and FIG. 1F, during the first period I, the organic light-emitting diode circuit 100 is operated under an operational state (e.g., reset state). The voltage level of the scan signal Sn-1 is with a high level (High), and the control end of the transistor T3 receives the scan signal Sn-1. In this situation, the transistor T3 is turned on and the reference voltage Vref is connected to the first end (node g) of the capacitor C1 through the transistor T3 at the on state so that the voltage level at the first end of the capacitor C1 is equal or substantially equal to the voltage level of the reference voltage Vref.

In the reset state, the voltage level of the scan signal Sn is a low level (Low) so that the transistor T5 and the transistor T6 are not turned on. The voltage level of the scan signal Sn-1 is a high level (High), and the control end of the transistor T4 receives the scan signal Sn-1. At this time, the transistor T4 is turned on, the transistor T4 provides a current path which connects the transistor T1 and the transistor T4 in series according to the scan signal Sn-1 (in other words, the current path is activated by the scan signal Sn-1) so that a path is formed between the second end of the capacitor C1 (node m) and the second end of the transistor T1 (node s), and a voltage level at the second end of the capacitor C1 is equal or substantially equal to a voltage level at the second end of the transistor T1 (node s), that is, the voltage level at the node m is equal or substantially equal to the voltage at the node s.

As shown in FIG. 1F, the light-emitting signal EM is a voltage level with a high level VGH, the transistor T2 is turned on according to the light-emitting signal EM during the first period. Reference is made to FIG. 1B. Both the transistor T2 and the transistor T4 are under the on state at this time, the second end of the capacitor C2 (node a) is electrically coupled to the node s and node m so that the voltage level at the node m and at the node s are equal or substantially equal to the voltage level at the node a, for thereby resetting the voltage level at the capacitor C2.

In the reset state, a cross voltage Vgm crossing the capacitor C1 is equal or substantially equal to a previous threshold voltage Vpre_th of the transistor T1 (i.e., a threshold voltage stored during the last frame period) so that the capacitor C1 stores the threshold voltage Vth of the transistor T1. In the meantime, a cross voltage Vgs crossing between the second end of the transistor T1 (node s) and the control end of the transistor T1 (node g) is also the previous threshold voltage Vpre_th of the transistor T1. In other words, the cross voltage Vgs is the same with the cross voltage Vgm crossing the capacitor C1. To facilitate the description, hereinafter the voltage level of the node s during the first period is called as the first voltage level.

Figure 1C:
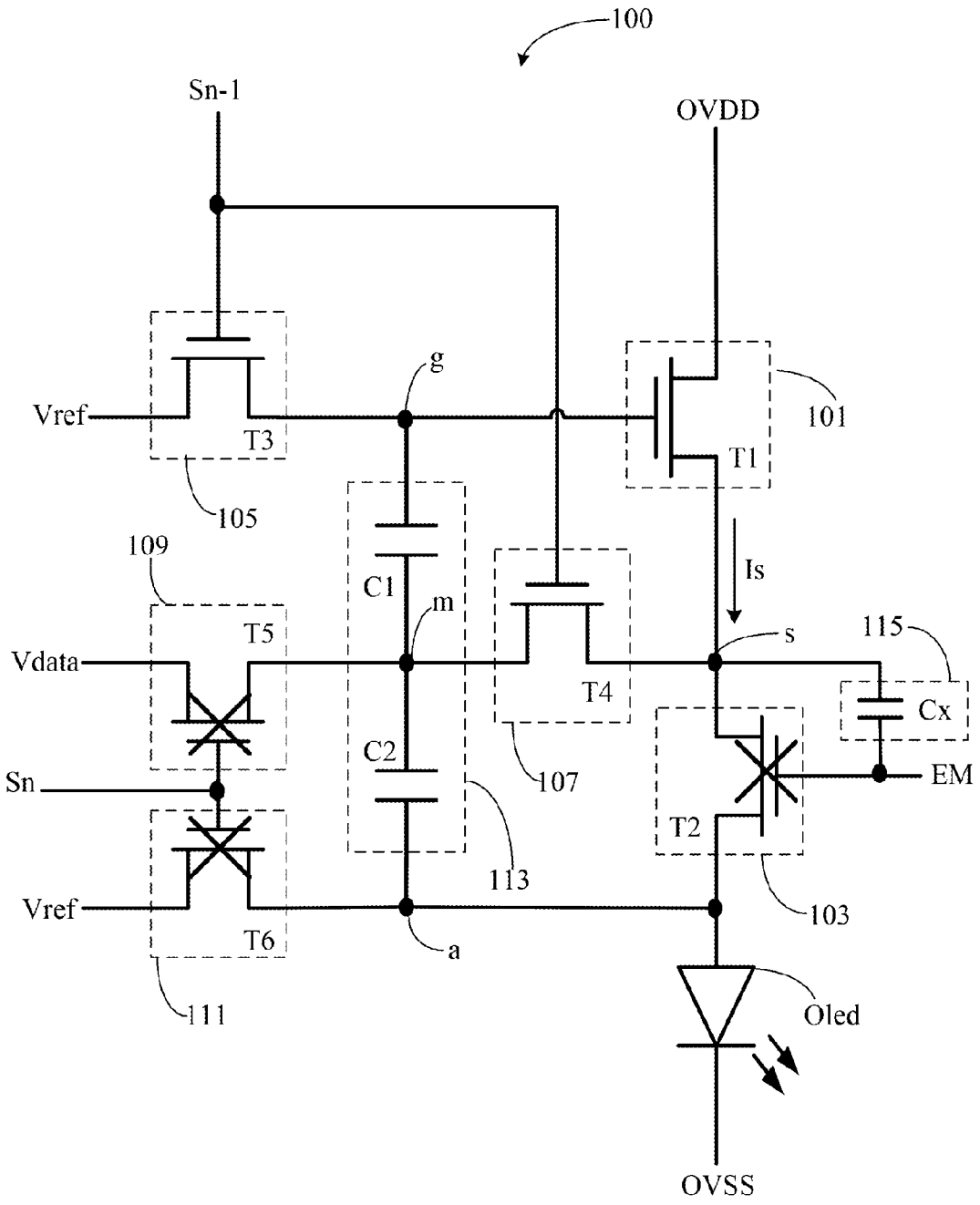

Reference is made to FIG. 1C. FIG. 1C is an operational diagram of an operational period (e.g., a compensation period) according to the organic light-emitting diode circuit 100 shown in FIG. 1A. Reference is made to FIG. 1C in conjunction with FIG. 1F; FIG. 1F is an operational timing sequences of the organic light-emitting diode circuit 100 illustrated in FIG. 1C.

As shown in FIG. 1C and FIG. 1F, during the second period II, the organic light-emitting diode circuit 100 is operated under an operational state (e.g., compensation state), the voltage level of the scan signal Sn is a low level so that both the transistor T5 and the transistor T6 are at the off state.

Under the compensation state, the voltage level of the light-emitting signal EM converts from a high level into a low level, and the transistor T2 is at the off state, so that the organic light-emitting diode Oled does not emit light. The control end of the transistor T3 and the control end of the transistor T4 receive the scan signal Sn-1, wherein at the mean time the voltage level of the scan signal Sn-1 is a high level (High), so that the transistor T3 and the transistor T4 are turned on. The transistor T4 provides a current path which connects the transistor T1 and the transistor T4 in series according to the scan signal Sn-1 (in other words, the current path is activated by the scan signal Sn-1) so that a path is formed between the second end of the capacitor C1 and the second end of the transistor T1. At this time, the voltage level at the second end of the transistor T1 (node s) will be converted from a first voltage level into a second voltage level since a voltage level variation of a feed through a voltage Vfeed_through is formed due to the light-emitting signal EM converting from a high level into the low level, hereafter the feed through voltage is marked as Vfeed_through, and the feed through voltage Vfeed_through can be got according to the following formula (1):

$$\text{Vfeed_through} = (VGH - VGL) \times \frac{Cgd}{C1 + Cgd} \quad (1)$$

Wherein VGH is the voltage level of the light-emitting signal EM with the high level, and VGL is the voltage level of the light-emitting signal EM with the low level. Since the voltage level at the second end of the transistor T1 (node s) enlarges the feed through voltage Vfeed_through, the voltage level at the node m substantively enlarges the feed through voltage Vfeed_through. For the cross voltage Vgm crossing the capacitor C1, it is equal or substantially equal to the sum of the last threshold voltage Vpre_th and the feed through voltage Vfeed_through.

That is to say, a difference between the first voltage level and the second voltage level is generated according to a divided voltage dividing the light-emitting signal EM by the coupling capacitor Cx and the capacitor C1. In addition, the coupling capacitor Cx is converted the voltage level at the second end of the transistor T1 (node s) from the first voltage level into the second voltage level according to the voltage level at the second end of the transistor T1 (node s) and the voltage level variation of the second end of the coupling capacitor Cx. In such cases, the cross voltage Vgm crossing the capacitor C1 is equal or substantially equal to Vpre_th+Vfeed_through, that is, the cross voltage Vgm crossing the capacitor C1 is equal or substantially equal to a sum of the last threshold voltage Vpre_th and the feed through voltage Vfeed_through of the second end of the transistor T1.

In addition, at the compensation state, the scan signal Sn-1 is a high voltage level (High), the transistor T4 receives the scan signal Sn-1 and provides a current path which connects the transistor T1 and the transistor T4 in series according to the scan signal Sn-1 so that the voltage level at the second end of the transistor T1 (node s) converts from the second voltage level into a third voltage level. In detail, when the voltage level at the node s is with the second voltage level and when the transistor T1 is at the on state, the driving current Is continuously flows to the second end of the capacitor C1 (node m) through the transistor T1 from the voltage source OVDD, hence reducing the cross voltage Vgm crossing the capacitor C1 till the cross voltage Vgm crossing the capacitor C1 is equal or substantially equal to the threshold voltage of the transistor T1, turning the transistor T1 from the on state to the off state, so that the voltage level of the second end of the capacitor C1 (node m) would no longer change.

In addition, if the period II is not long enough, the voltage level at the second end of the capacitor C1 (node m) will not have sufficient time to convert, this may lead to the cross voltage Vgm crossing the capacitor C1 not being equal or substantially equal to the threshold voltage Vth of the transistor T1. At this time, the cross voltage Vgm crossing the capacitor C1 is equal or substantially equal to (Vth+ΔV(t)), wherein ΔV(t) is compensating deviation voltage, and the third level corresponds to the compensating deviation voltage ΔV(t). In other words, the cross voltage Vgm crossing the capacitor C1 is the threshold voltage Vth of the transistor T1 plus the compensating deviation voltage ΔV(t).

Therefore, in the compensation operations, the threshold voltage Vth of the transistor T1 (or similar to the threshold voltage Vth of the transistor T1) is stored in the capacitor C1. Since the cross voltage Vgm crossing the capacitor C1 is changed by the coupling of the capacitor C1 on a basis of the last threshold voltage Vpre_th, to start the compensation operation, therefore, under the premise that the threshold voltage Vth of the transistor T1 during each frame period does not have much difference, the starting point of the voltage variation at the compensation operation is similar to the practical threshold voltage Vth of the transistor T1, so that, after the compensation operation, the cross voltage Vgm crossing the capacitor C1 is ensured to be more close to the threshold voltage Vth of the transistor T1.

Figure 1D:
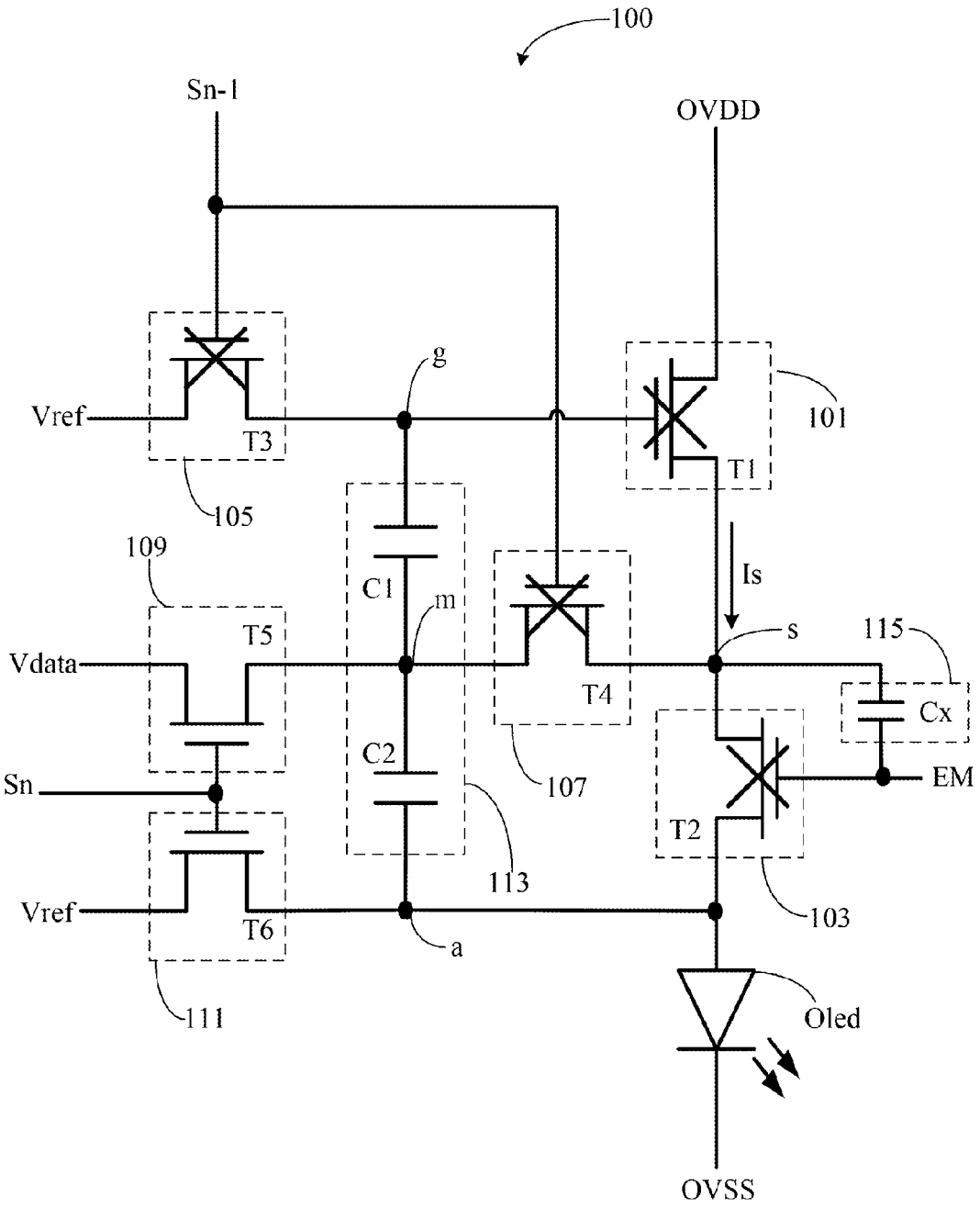

Reference is made to FIG. 1D. FIG. 1D is an operational diagram of an operational period (e.g., a data writing period) according to the organic light-emitting diode circuit 100 shown in FIG. 1A. Reference is made to FIG. 1D in conjunction with FIG. 1F. FIG. 1F is an operational timing sequences of the organic light-emitting diode circuit 100 illustrated in FIG. 1D.

As shown in FIG. 1D and FIG. 1F, the organic light-emitting diode circuit 100 is operated in an operational state (e.g., data writing state) during the period III, the voltage level of the scan signal Sn-1 is converted from a high level into a low level, the transistor T3 and the transistor T4 are at the off state, and the transistor T1 is also at the off state. At this time, the voltage level of the light-emitting signal EM is with a low level and the transistor T2 is at the off state, while the organic light-emitting diode Oled does not emit light.

Under the data writing state, the voltage level of the scan signal Sn is converted from a low level into a high level, the control end of the transistor T5 and the control end of the transistor T6 receives the scan signal Sn, and the two transistors turn on according to the scan signal Sn. A first end of the transistor T5 is electrically coupled to the data voltage Vdata and receives the data voltage Vdata to transmit the voltage level of the data voltage Vdata to the first end (node m) of the capacitor C2 of the storage unit 113 according to the scan signal Sn. At this time, the voltage level at the first end of the capacitor C2 (i.e., the second end of the capacitor C1) is controlled by the data voltage Vdata, and the voltage level at the node m is the voltage level of the data voltage Vdata.

As shown in FIG. 1D, the first end of the transistor T6 is electrically coupled to the reference voltage Vref and transmits the reference voltage Vref to the second end of the capacitor C2 (node a) of the storage unit 113 according to the scan signal Sn. At this time, the voltage level at the second end of the capacitor C2 is the reference voltage Vref, that is, the voltage level at the node a is the reference voltage Vref. In such cases, the data voltage Vdata is the voltage level at the first end of the capacitor C2 while the reference voltage Vref is the voltage level at the second end of the capacitor C2, the cross voltage Vma crossing the capacitor C2 is equal or substantially equal to (Vdata-Vref), that is, the cross voltage Vma crossing the capacitor C2 is the data voltage Vdata minus the reference voltage Vref. Therefore, under the data writing state, the data voltage Vdata and the reference voltage Vref can be written into the capacitor C2.

Since the cross voltage Vgm crossing the capacitor C1 is known as (Vth+ΔV(t)), and the cross voltage Vma crossing the capacitor C2 is (Vdata-Vref), then the cross voltage Vga crossing the storage unit 113 is equal or substantially equal to (Vth+ΔV(t)+Vdata−Vref).

Figure 1E:
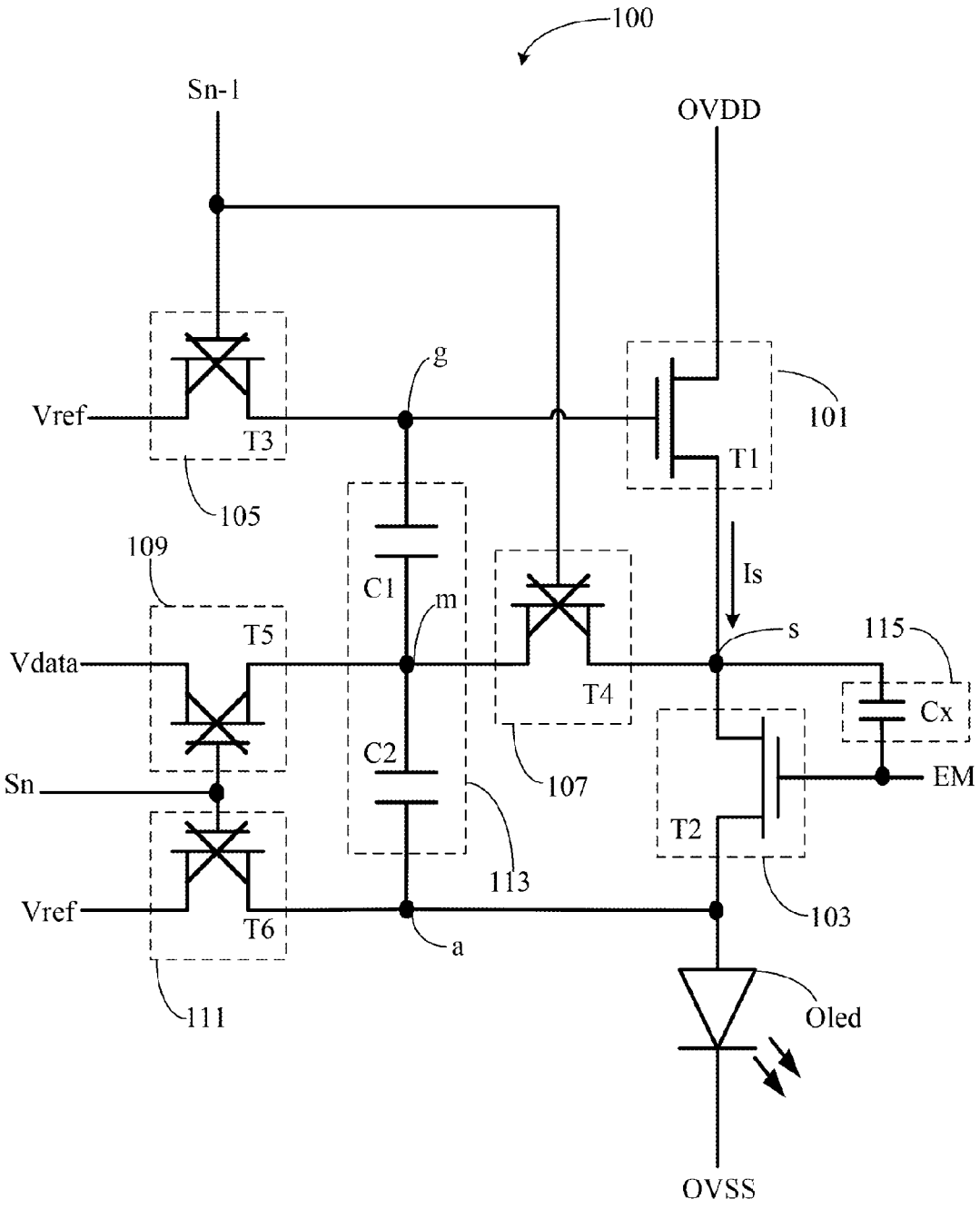
Figure 1F:
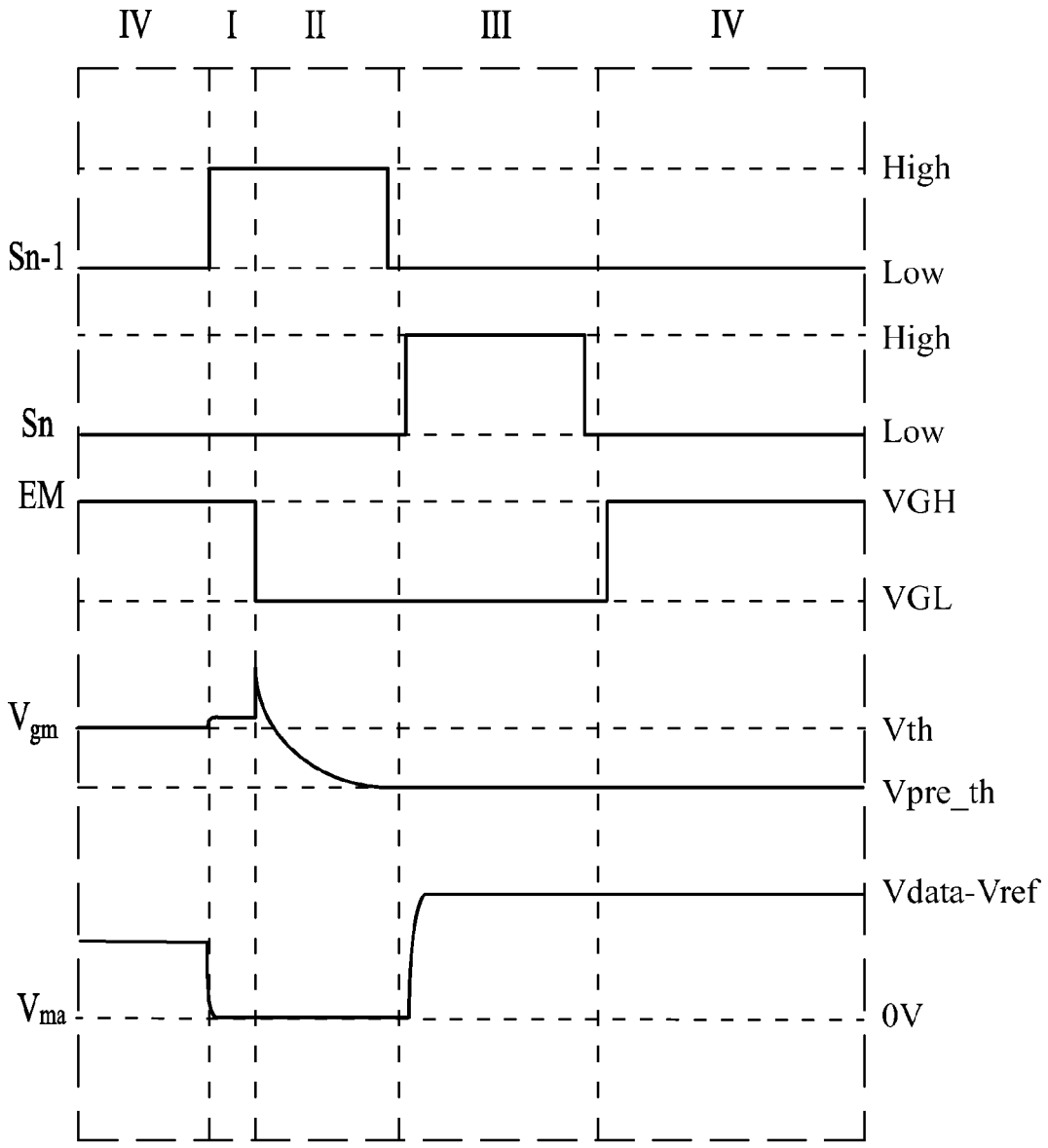
FIG. 1F is an operational timing sequences of the organic light-emitting diode circuit illustrated in FIG. 1B.

Reference is made to FIG. 1E. FIG. 1E is an operational diagram of an operational period (e.g., a radiating period) according to the organic light-emitting diode circuit 100 shown in FIG. 1A. Reference is made to FIG. 1E in conjunction with FIG. 1F; FIG. 1F is an operational timing sequences of the organic light-emitting diode circuit 100 illustrated in FIG. 1E.

As shown in FIG. 1E and FIG. 1F, the organic light-emitting diode circuit 100 is operated under an operational state (e.g., radiating state) during the period IV, the voltage level of the scan signal Sn-1 and the voltage level of the scan signal Sn-1 are a low level (Low), and the transistors T3, T4, T5, T6 are at the off state. The transistor T1 is turned on since it is driven by a voltage stored in the storage unit 113. When the voltage level of the light-emitting signal EM is converted from a low level into a high level, the transistor T2 is turned on, and the driving current Is generated by the second end of the transistor T1 flows into the organic light-emitting diode Oled through the transistor T2 so that the organic light-emitting diode Oled emits light.

Under the radiating state, the cross voltage Vgs crossing between the node g and the node s is equal or substantially equal to Vga−Vds_T2, that is, the cross voltage Vgs crossing between the node g and the node s is the cross voltage Vga crossing the storage unit 113 minus the cross voltage Vds_T2 crossing between the first end and the second end of the transistor T2. In addition, the cross voltage Vga crossing the storage unit 113 is equal or substantially equal to (Vth+ΔV(t)+Vdata−Vref), that is, the cross voltage Vgs crossing between the node g and the node s can be derived from the following formula (2):

$$\begin{aligned} Vgs &= Vga - \mathrm{Vds_T2} \\ &= Vdata - Vref + Vth + \Delta V(t) - \mathrm{Vds_Ts} \end{aligned} \tag{2.}$$

Besides, the driving current Is of the second end of the transistor T1 can be derived from the following formula (3):

$$\begin{aligned} Is &= 1/2K(Vgs - Vth)^2 \\ &= 1/2K(Vdata - Vref + Vth + \Delta V(t) - \mathrm{Vds_T2} - Vth)^2 \\ &= 1/2K(Vdata - Vref + \Delta V(t) - \mathrm{Vds_T2})^2 \end{aligned} \tag{3.}$$

Wherein K is a constant. Therefore, from the above formulas, it is known that the driving current Is of the organic light-emitting diode Oled will not be affected by the threshold voltage Vth of the transistor T1, that is, even if the threshold voltage Vth of the transistor T1 differs due to variations of the manufacturing process, the luminance of the organic light-emitting diode will be the same.

In this way, the organic light-emitting diode circuit is applied to the organic light-emitting diode displays, since the capacitor varies on a basis of the threshold voltage of the transistor, and the threshold voltage of the transistor during each frame period are similar to each other, therefore, under the compensation operations, the variations of the voltages stored in the capacitor are similar to the threshold voltage of the transistor, thus reducing the charging time of the capacitor, and improving the insufficient charge of the capacitor. In this way, the organic light-emitting diode circuit can restrain the variation of the driving current in a short space of time while the problems of the mura of the display are resolved.

According to an embodiment of the present disclosure, a driving method of an organic light-emitting diode circuit is disclosed; the driving method can be applied to the organic light-emitting diode circuit the same as or similar to the organic light-emitting diode circuit 100 in the aforementioned FIG. 1A, further descriptions are omit here for the sake of the brevity. The driving method includes the following steps. For illustrative purposes, the following method is using the embodiments illustrated in, but not limited to, FIG. 1B, FIG. 1C, FIG. 1D and FIG. 1E, as embodiments.

Firstly, as shown in FIG. 1B and FIG. 1F, at the period I, the reset unit 107 and the compensation unit 105 are driven with the scan signal Sn-1, and the switch unit 103 is driven with the light-emitting signal EM. In addition, the first end of the capacitor C1 is further provided the reference voltage Vref, the transistor T1 is turned on, and the second end of the transistor T1 controls the second end of the capacitor C2.

In an embodiment, during the period I the driving method further includes the following steps: providing a scan signal Sn-1 with a first level to the reset unit 107 and the compensation unit 105; providing the scan signal Sn with a second level to the input unit 109 and the reset unit 111; and providing the light-emitting signal EM with a first level to the switch unit 103, wherein the first level differs from the second level.

It is noted that, the high level (High) and the low level (Low) as shown in FIG. 1F can be used to represent the first level and the second level described herein and below, however, it is not meant to be a limitation of the present disclosure, people skilled in this art may adjust the definitions of the first level and the second level according to the design requirements.

In this way, the reset unit 107 and the compensation unit 105 can be turned on according to the scan signal Sn-1 so that the voltage level at the first end of the capacitor C1 is the reference voltage Vref, and the voltage level at the second end of the capacitor C1 is the electrical potential at the second end of the transistor T1, thereby resetting the capacitor C1. Since the detailed operations have been described in the embodiment illustrated in FIG. 1B, further descriptions hence are omitted for the sake of the brevity.

Next, as shown in FIG. 1C and FIG. 1F, during the period II, the reset unit 107 and the compensation unit 105 is driven with the scan signal Sn-1, and the first end of the capacitor C1 is provided the reference voltage Vref so that the second end of the transistor T1 connects to the second end of the capacitor C1, and change a voltage level of the second end of the first transistor from a first voltage level to a second voltage level according to the voltage level variation of the second end of the coupling capacitor Cx and the first voltage level of the second end of the transistor T1, and to change the voltage level of the second end of the transistor T1 from the second voltage level to a third voltage level according to a current path which connects the transistor T1 and the compensation unit 105 in series wherein the current path is activated by the scan signal Sn-1.

In an embodiment, during the period II, the driving method further includes the following steps: providing a scan signal Sn-1 with a first level to the reset unit 107 and the compensation unit 105; providing the scan signal Sn with a second level to the input unit 109 and the reset unit 111; and switching the light-emitting signal EM from the first level to the second level; and providing the light-emitting signal EM with the second level to the switch unit 103.

In this way, the threshold voltage Vth of the transistor T1 can be stored in the capacitor C1, and the voltage level of the second end of the transistor T1 can be dynamically adjusted, since the detailed operations have been described in the embodiment illustrated in FIG. 1C, further descriptions hence are omitted for the sake of the brevity.

Next, as shown in FIG. 1D and FIG. 1F, during the period III, the input unit 109 is driven with the scan signal Sn for providing a data voltage Vdata to the first end of the second capacitor C2, and the reset unit 111 is driven with the scan signal Sn for providing the reference voltage Vref to the second end of the second capacitor C2.

In an embodiment, during the period III the driving method further includes the following steps: switching the scan signal Sn-1 with a first level into the scan signal Sn-1 with a second level, and providing the scan signal Sn-1 with the second level to the reset unit 107 and the compensation unit 105; switching the scan signal Sn with the second level to the scan signal Sn with the first level, and providing the scan signal Sn with the first level to the input unit 109 and the reset unit 111; and providing the light-emitting signal EM with the second level to the switch unit 103.

In this way, the voltage level at the first end of the capacitor C2 is the data voltage Vdata and the voltage level at the second end of the capacitor C2 is the reference voltage Vref, so that the data voltage Vdata and the reference voltage Vref can be written into the capacitor C2. Since the detailed operations have been described in the embodiment illustrated in FIG. 1D, further descriptions hence are omitted for the sake of the brevity.

Finally, as shown in FIG. 1E and FIG. 1F, the switch unit 103 is driven with the light-emitting signal EM during the period IV so that the driving current Is flows into the organic light-emitting diode Oled through the switch unit 103, and the organic light-emitting diode Oled emits light, wherein the driving current Is is generated by the transistor T1.

In an embodiment, during the period IV the driving method further includes the following steps: providing the scan signal Sn-1 with the second level to the reset unit 107 and the compensation unit 105; switching the scan signal Sn with the first level into the scan signal Sn with the second level, and providing the scan signal Sn with the second level to the input unit 109 and the reset unit 111; and switching the light-emitting signal EM with the second level into the light-emitting signal EM with the first level, and providing the light-emitting signal EM with the second level to the switch unit 103.

In this way, the driving current Is of the organic light-emitting diode Oled is not affected by the threshold voltage Vth of the transistor T1. Since the detailed operations have been described in the exemplary embodiment illustrated in FIG. 1E, further descriptions hence are omitted for the sake of the brevity.

By applying the aforementioned steps, the driving current Is which drives the organic light-emitting diode Oled to emit light would not change along with the variations of the threshold voltage Vth of the transistor T1. Therefore, if the aforementioned method is applied to the organic light-emitting diode circuit of the organic light-emitting diode display, the problems of the mura of the display may be resolved.

Figure 2A:
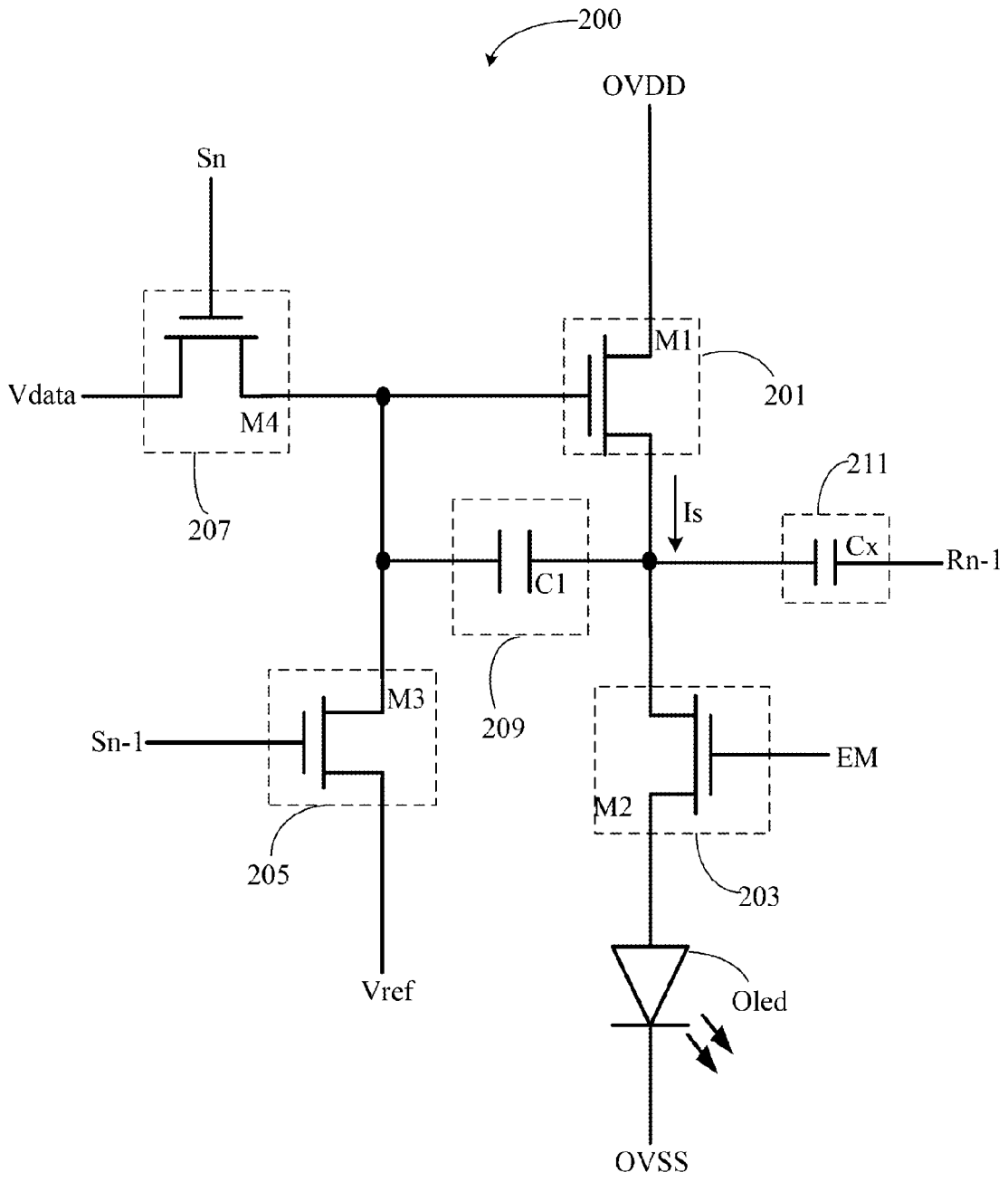
FIG. 2A is a diagram illustrating an exemplary embodiment of the organic light-emitting diode circuit of the present disclosure.

According to another embodiment of the present disclosure, an organic light-emitting diode circuit 200 is disclosed. FIG. 2A is a diagram illustrating an embodiment of the organic light-emitting diode circuit of the present disclosure.

As shown in FIG. 2A, the organic light-emitting diode 200 includes a driving unit 201, a switch unit 203, a reset unit 205, an input unit 207, a storage unit 209, a coupling unit 211, and an organic light-emitting diode Oled.

In this embodiment, the driving unit 201 includes a transistor M1. The switch unit 203 includes a transistor M2. The reset unit 205 includes a transistor M3. The input unit 207 includes a transistor M4. In addition, each of the transistors M1-M4 includes a first end (e.g., drain), a second end (e.g., source), and a control end (e.g., gate), and the transistors M1-M4 can be P type transistors or N type transistors. The storage unit 209 includes a capacitor C1, and the coupling unit 211 includes a coupling capacitor Cx.

In structure, the first end of the transistor M1 is electrically coupled to the voltage source OVDD and receives the voltage of the voltage source OVDD. The control end of the transistor M1 is electrically coupled to a first end of the capacitor C1 of the storage unit 209, and the second end of the transistor M1 is electrically coupled to the second end of the capacitor C1 of the storage unit 209, wherein the transistor M1 is driven by a voltage stored in the storage unit 209, for providing a driving current Is from the second end of the transistor M1.

In this embodiment, the capacitor C1 of the storage unit 209 has a first end and a second end. The first end of the capacitor C1 is electrically coupled to the control end of the transistor, and the second end of the capacitor C1 is electrically coupled to a first end of the transistor M2 and the second end of the transistor M1.

As shown in FIG. 2A, the coupling capacitor Cx of the coupling unit 211 has a first end and a second end. The first end of the coupling capacitor Cx is electrically coupled to the second end of the transistor M1 and the second end of the capacitor C1, and the second end of the coupling capacitor Cx is configured to receive the control signal Rn-1.

In this embodiment, the first end of the transistor M2 is electrically coupled to the second end of the transistor M1, the second end of the transistor M is electrically coupled to an anode of the organic light-emitting diode Oled, and a cathode of the organic light-emitting diode Oled is electrically coupled to the voltage source OVSS. The control end of the transistor M2 is configured to receive the light-emitting signal EM and turned on according to the light-emitting signal EM so that the driving current Is is transmitted to the organic light-emitting diode Oled through the transistor M2. Then, the organic light-emitting diode Oled receives the driving current Is and emits light according to the driving current Is.

As shown in FIG. 2A, the first end of the transistor M3 is electrically coupled to the first end of the capacitor C1, and the control end of the transistor M3 is configured to receive the scan signal Sn-1. Moreover, the second end of the transistor M3 is electrically coupled to the reference voltage Vref and configured to receive reference voltage Vref.

In this embodiment, the first end of the transistor M4 is electrically coupled to the data voltage Vdata and configured to receive data voltage Vdata. The second end of the transistor M4 is electrically coupled to the first end of the capacitor C1 of the storage unit 209. The control end of the transistor M4 is configured to receive the scan signal Sn, and the transistor M4 transmits the data voltage Vdata to the first end of the capacitor C1 of the storage unit 209 according to the scan signal Sn.

Figure 2B:
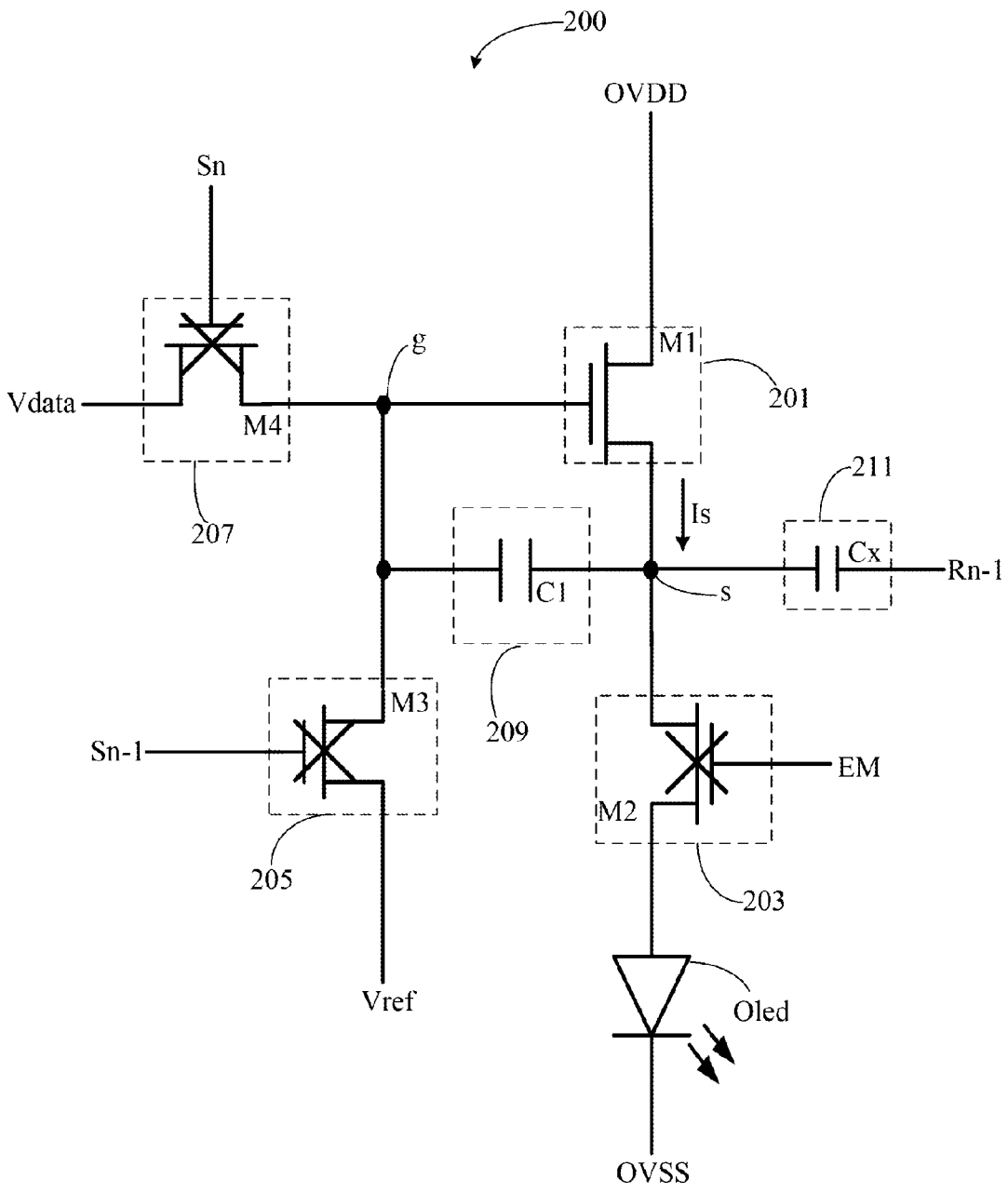
FIG. 2B-2F are operational diagrams of an operational period according to the organic light-emitting diode circuit of FIG. 2A.

In practice, Reference is made to FIG. 2B. FIG. 2B is an operational diagram of an operational period (e.g., a charging period) according to the organic light-emitting diode circuit 200 shown in FIG. 2A. Reference is made to FIG. 2B in conjunction with FIG. 2G. FIG. 2G is an operational timing sequence of the organic light-emitting diode circuit 200 illustrated in FIG. 2B.

As shown in FIG. 2B and FIG. 2G, during the period I, the organic light-emitting diode circuit 200 is operated under an operational state (e.g., charging state), the voltage of the control signal Rn-1 is with a high level (High), and the second end of the coupling capacitor Cx receives the control signal Rn-1 so that the control signal Rn-1 charges the coupling capacitor Cx for thereby controlling the voltage level of the coupling capacitor Cx. The control end of the transistor M3 receives the scan signal Sn-1 and the control end of the M4 receives the scan signal Sn; at this time, both the scan signal Sn-1 and the scan signal Sn are with a low level, to make both the transistors M3 and M4 be under an off state. In addition, the voltage level of the light-emitting signal Em is converted from the high level into the low level (Low) so that the transistor M2 is under the off state. At this time, the organic light-emitting diode Oled does not emit light.

In the charging state, a first end of the coupling capacitor Cx is electrically coupled to the second end of the transistor M1 (node s), and the control signal Rn-1 changes the voltage level of the coupling capacitor Cx when the control signal Rn-1 charges the coupling capacitor Cx. In other words, the coupling capacitor Cx make the voltage (Vs) of the second end of the transistor M1 (node s) from the first voltage level V1 convert into the second voltage level V2 according to the voltage level variation of the control signal Rn-1 and the second end of the transistor M1, wherein the first voltage level V1 is the initial voltage level of the node s, and the second voltage level V2 is the voltage level at the node s after the coupling capacitor Cx being charged. Moreover, after the coupling capacitor Cx being charged according to the control signal Rn-1, the voltage level of the light-emitting signal Em converts from a high level into a low level so that the transistor M2 under the off state. At this time, the coupling capacitor Cx starts to discharge so that the voltage level at the node s starts to decline.

Figure 2C:
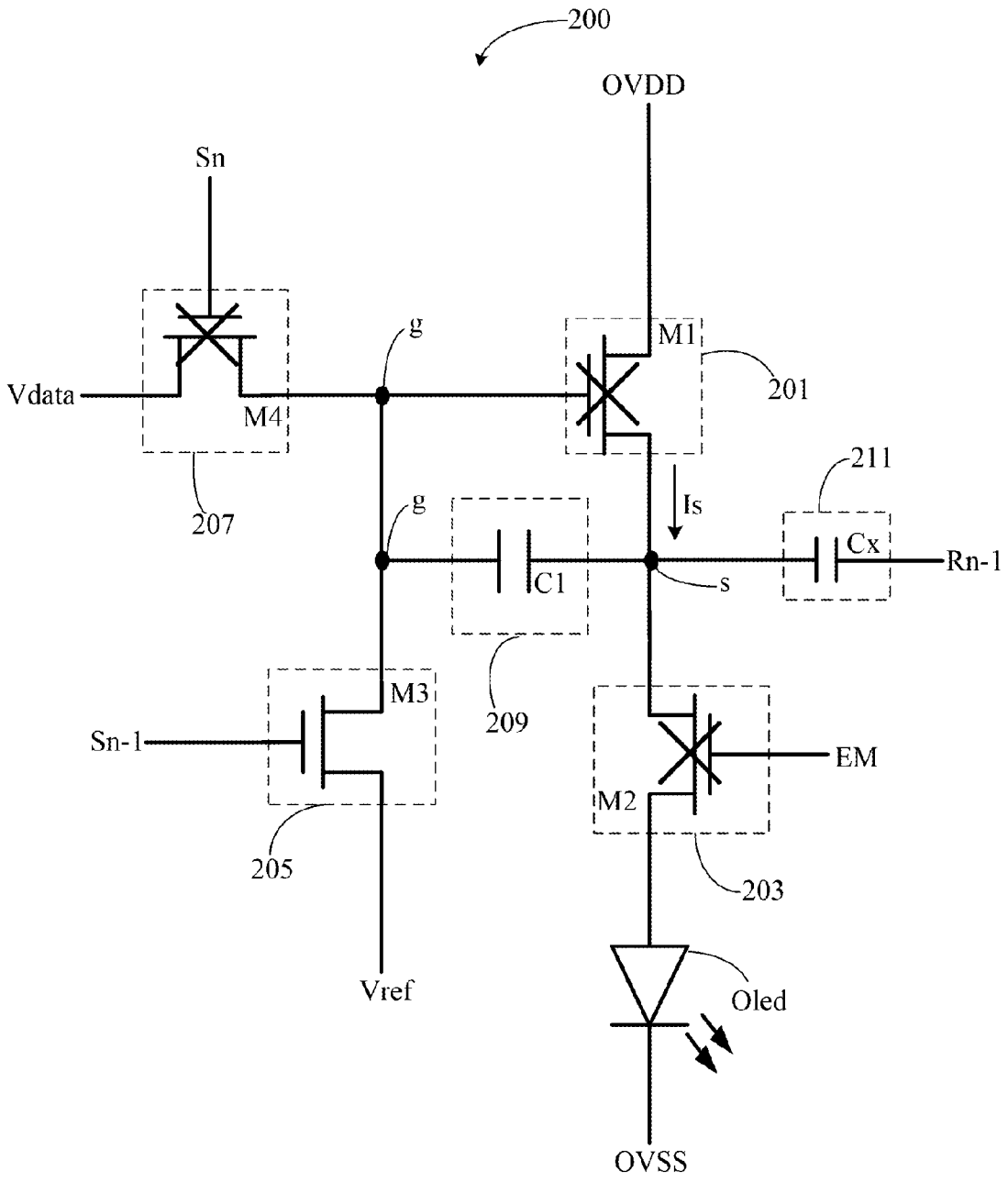

Reference is made to FIG. 2C. FIG. 2C is an operational diagram of an operational period (e.g., a compensation period) according to the organic light-emitting diode circuit 200 of FIG. 2A. Reference is made to FIG. 2C in conjunction with FIG. 2G. FIG. 2G is an operational timing sequences of the organic light-emitting diode circuit 200 illustrated in FIG. 2C.

As shown in FIG. 2C and FIG. 2G, the organic light-emitting diode circuit 200 is operated under an operational state (e.g., compensation state) during the period II, wherein both the light-emitting signal EM and the scan signal Sn are with a low level, both the transistor M2 and the transistor M4 are under the off state, at this time, the organic light-emitting diode Oled does not emit light.

Under the compensation state, the voltage level of the scan signal Sn-1 is converted from a low level into a high level, and the transistor M3 is turned on according to the scan signal Sn-1 so that the voltage level (Vg) at the control end (node g) of the transistor M1 is equal or substantially equal to the reference voltage Vref. It should be noted that the first end of the capacitor C1 is electrically coupled to the control end of the transistor M1, so the first end of the capacitor C1 is the node g.

When the voltage level at the node s is the second voltage level and the transistor M1 is under the on state, the driving current Is continuously flows to the second end of the capacitor C1 (node s) through the transistor M1 from the voltage source OVDD, hence reducing the cross voltage Vgm crossing the capacitor C1 till the cross voltage Vgm crossing the capacitor C1 is equal or substantially equal to the threshold voltage of the transistor M1, turning the transistor M1 from the on state to the off state, so that the voltage level of the second end of the capacitor C1 (node s) would no longer change. Since the voltage level of the node g is reference voltage Vref, the voltage level at the node s is equal or substantially equal to (Vref-Vth-|Verr1|), wherein Vth is the threshold voltage of the transistor M1, and Verr1 is the deviation value generated under the compensation period. For instance, if the period II is not long enough, the voltage level at the second end of the capacitor C1 (node s) will not have sufficient time for change, this may lead to the cross voltage Vgs crossing the capacitor C1 not being equal or substantially equal to the threshold voltage Vth of the transistor M1. At this time, the cross voltage Vgs crossing between the node g and the node s is the voltage level at the node g minus the voltage level at the node s, it can be derived from the following formula (4):

$$\begin{aligned} Vgs &= Vg - Vs \\ &= Vref - Vref + Vth + |Verr1| \\ &= Vth + |Verr1| \end{aligned} \tag{4.}$$

Therefore, in the compensation operations, the threshold voltage Vth of the transistor M1 (or similar to the threshold voltage Vth of the transistor M1) is stored in the capacitor C1. Under the premise that the threshold voltage Vth of the transistor M1 during each frame period does not have much difference, the starting point of the voltage variation at the compensation operation is similar to the practical threshold voltage Vth of the transistor M1, so that, after the compensation operation, the cross voltage Vgm crossing the capacitor C1 is ensured to be more close to the threshold voltage Vth of the transistor M1.

Figure 2D:
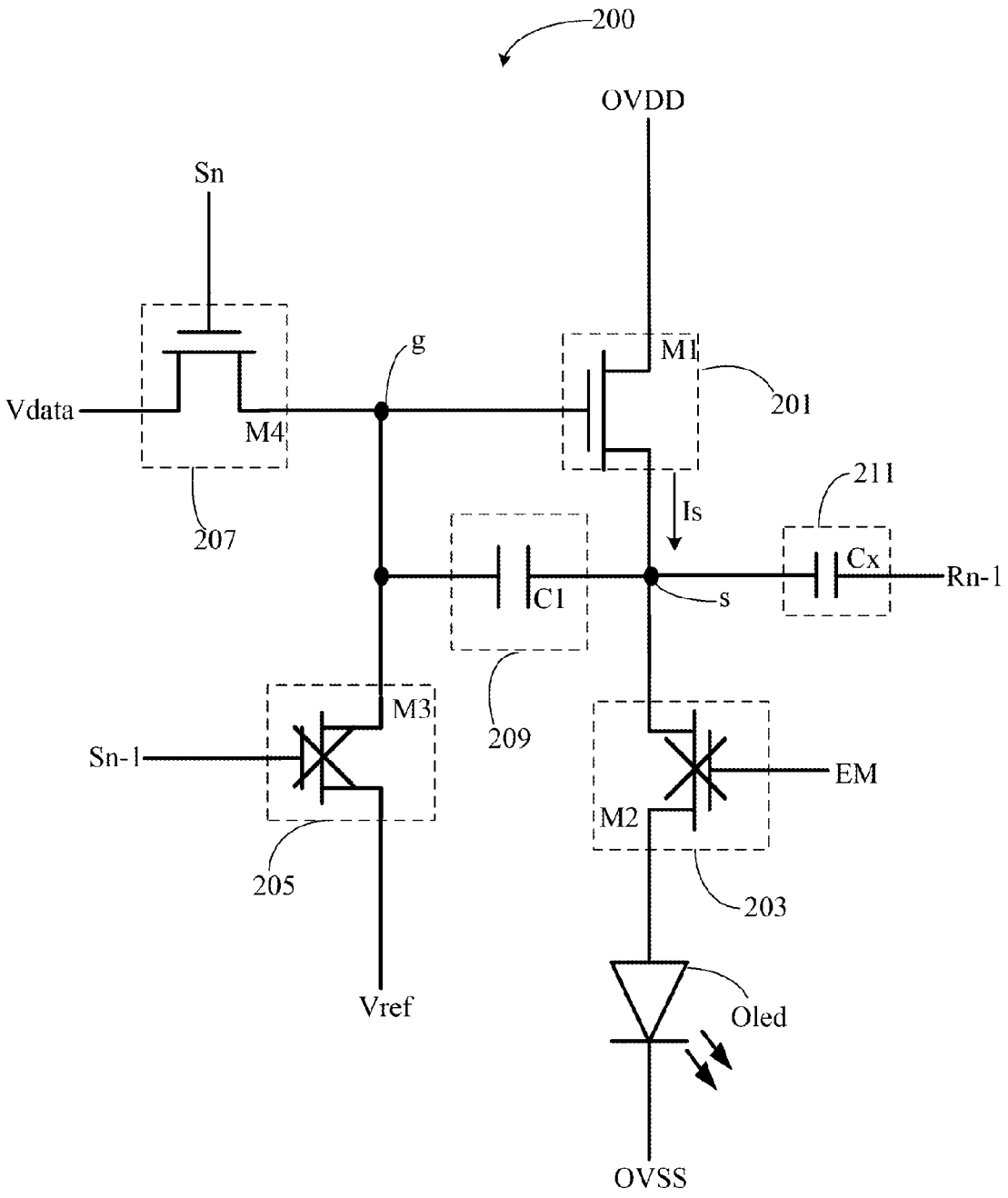

Reference is made to FIG. 2D. FIG. 2D is an operational diagram of an operational period (e.g., a data writing period) according to the organic light-emitting diode circuit 200 of FIG. 2A. Reference is made to FIG. 2D in conjunction with FIG. 2G. FIG. 2G is an operational timing sequences of the organic light-emitting diode circuit 200 illustrated in FIG. 2D.

As shown in FIG. 2D and FIG. 2G, the organic light-emitting diode circuit 200 is operated in an operational state (e.g., data writing state) during the period III, the voltage level of the scan signal Sn is a high level, and the transistor M4 is turned on according to the scan signal Sn. The voltage level of the node g is equal or substantially equal to the data voltage Vdata, the data voltage Vdata is with a low data voltage level (VDL) at this time so that the voltage level at the node g is the data voltage Vdata with a low data voltage level (VDL).

Under the data writing state, the voltage level of the control signal Rn-1 converts from a high level into a low level, at this time the voltage level at the node s is (Vref−Vth−(VRH−VRL)−|Verr1|), wherein VRH is the high voltage level of the control signal Rn-1, and VRL is the low voltage level of the control signal Rn-1. At this time, the driving current Is continuously flows to the second end of the capacitor C1 (node s) through the transistor M1 from the voltage source OVDD, hence reducing the cross voltage Vgm crossing the capacitor C1 till the cross voltage Vgm crossing the capacitor C1 is equal or substantially equal to the threshold voltage of the transistor M1. After the compensation operation, the voltage level at the node s is equal or substantially equal to (VDL-Vth-|Verr2|), wherein VDL is the low data voltage level of the data voltage Vdata, and |Verr2| is the deviation value generated during the compensation period. During the period III, the voltage level at the node g is the data voltage Vdata with the low data voltage level (VDL). In such cases, the cross voltage Vgs between the node g and the node s can be derived from the following formula (5):

$$\begin{aligned} Vgs &= Vg - Vs \\ &= VDL - VDL + Vth + |Verr2| \\ &= Vth + |Verr2| \end{aligned} \tag{5.}$$

Therefore, under the data writing state, the threshold voltage Vth of the transistor M1 is stored in the capacitor C1, under the premise that the threshold voltage Vth of the transistor M1 during each frame period does not have much difference, the starting point of the voltage variation at the compensation operation is similar to the practical threshold voltage Vth of the transistor M1, so that, after the compensation operation, the cross voltage Vgm of the capacitor C1 is ensured to be more close to the threshold voltage Vth of the transistor M1.

Figure 2E:
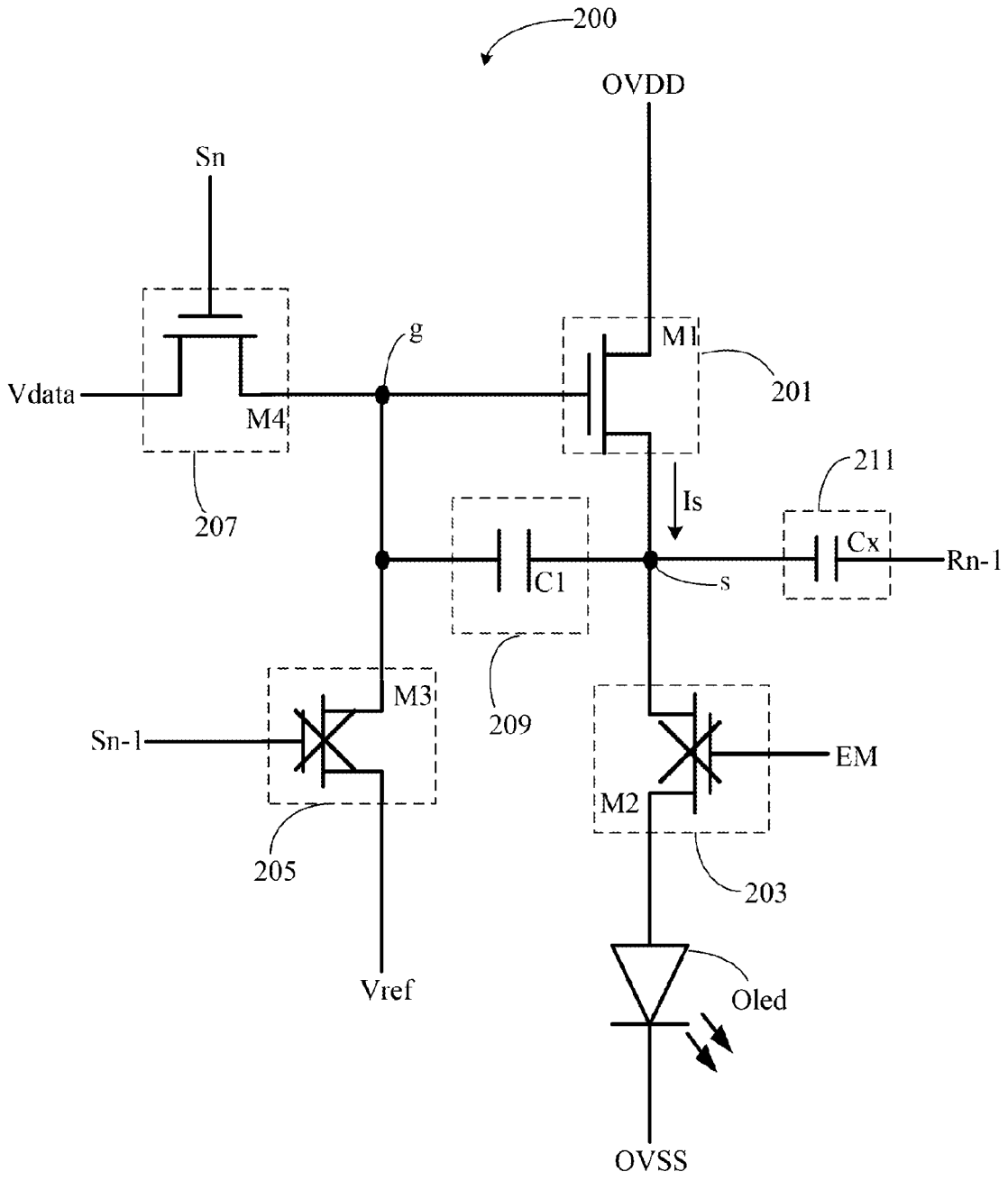

Reference is made to FIG. 2E. FIG. 2E is an operational diagram of an operational period (e.g., a data writing period) according to the organic light-emitting diode circuit 200 shown in FIG. 2A. Reference is made to FIG. 2E in conjunction with FIG. 2G. FIG. 2G is an operational timing sequences of the organic light-emitting diode circuit 200 illustrated in FIG. 2E.

As shown in FIG. 2E and FIG. 2G, the organic light-emitting diode circuit 200 is operated in an operational state (e.g., data writing state) during the period IV, the voltage level of the scan signal Sn is a high level, the control end of the transistor M4 receives the scan signal Sn and transmits the data voltage Vdata to the capacitor C1 of the storage unit 209 according to the scan signal Sn so that the voltage at the first end of the capacitor C1 is the data voltage Vdata.

Under the data writing state, the voltage level of the data voltage Vdata is converted from the low data voltage level (VDL) into the high data voltage level (VDH), at the moment that the voltage level of the data voltage Vdata increases, the voltage at the node g is the high data voltage level (VDH) of the data voltage Vdata. Therefore, in the data writing operation, the high data voltage level (VDH) of the data voltage Vdata can be written into the capacitor C1. In such cases, the voltage level at the node s can be derived from the following formula (6):

$$Vs = (VDH - VDL) \times \frac{C1}{C1 + Cgd} + VDL - Vth - |Verr2| \quad (6.)$$

In addition, the cross voltage Vgs crossing between the node g and the node s can be derived from the following formula (7):

$$\begin{aligned} Vgs &= VDH - (VDH - VDL) \times \frac{C1}{C1 + Cgd} - VDL + Vth + |Verr2| \quad (7.) \\ &= (VDH - VDL) \times \frac{C2}{C1 + Cgd} + Vth + |Verr2| \end{aligned}$$

Figure 2F:
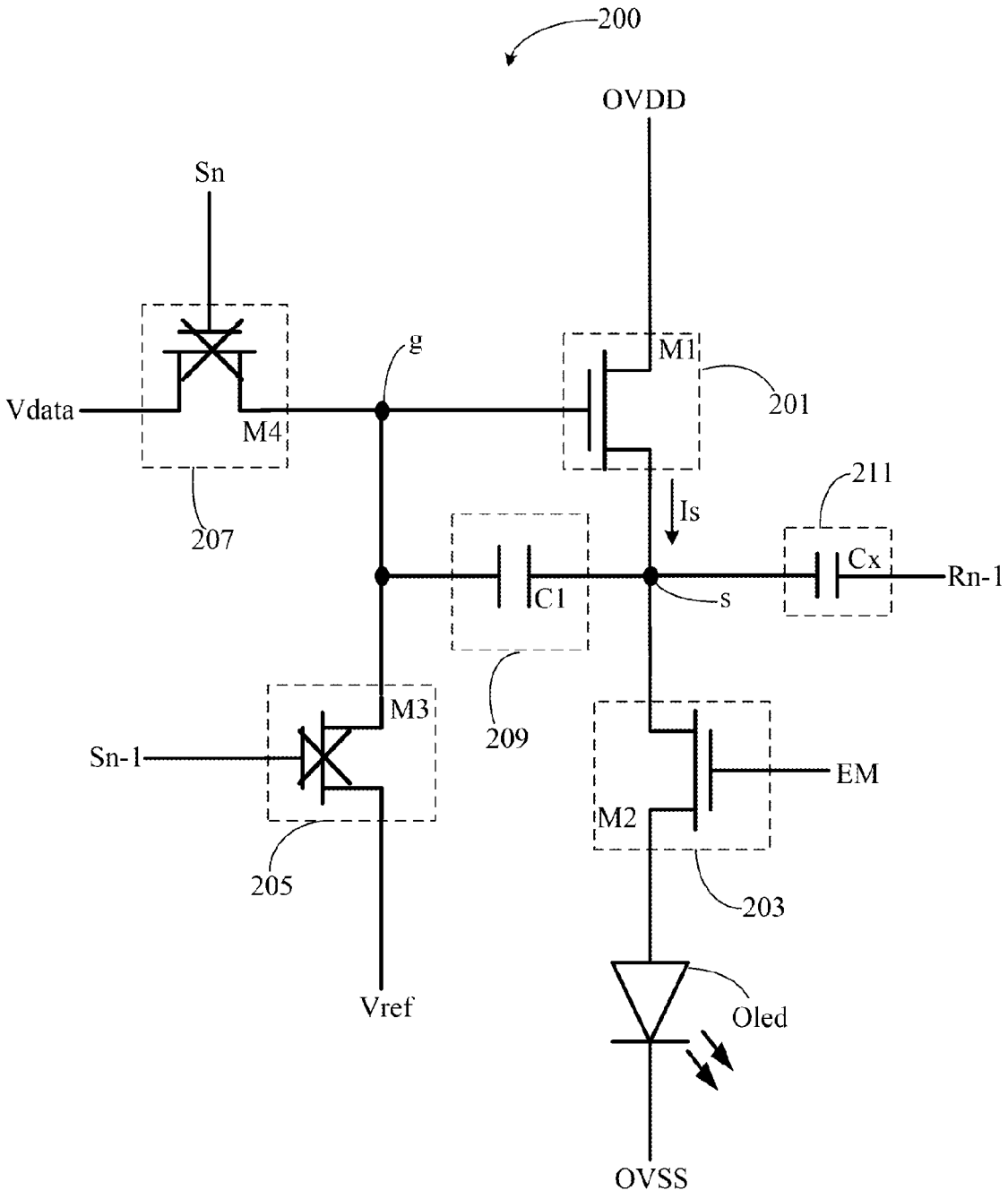
Figure 2G:
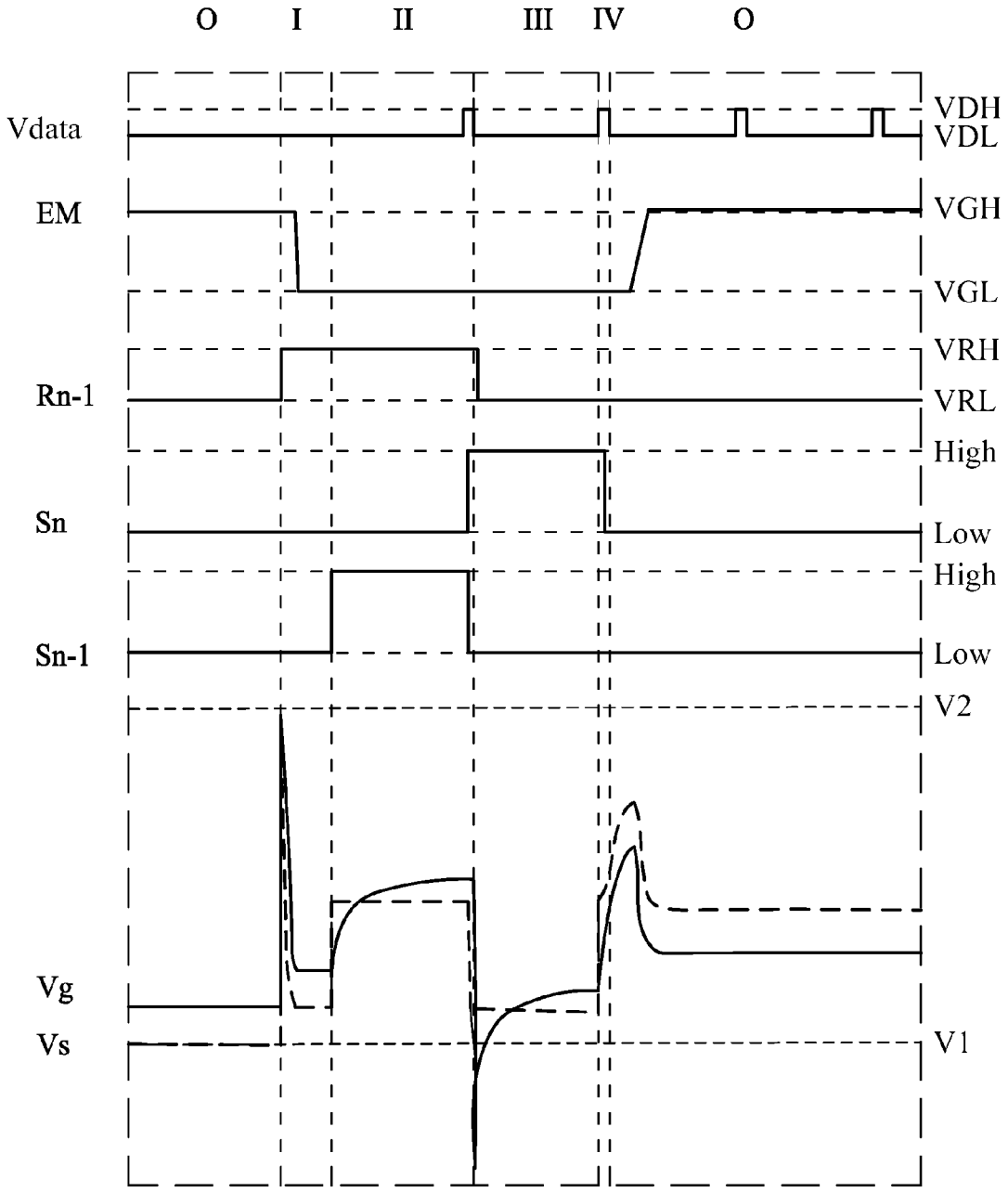
FIG. 2G is an operational timing sequence of the organic light-emitting diode circuit according to FIG. 2B-2F.

Reference is made to FIG. 2F. FIG. 2F is an operational diagram of an operational period (e.g., a radiating period) according to the organic light-emitting diode circuit 200 shown in FIG. 2A. Reference is made to FIG. 2F in conjunction with FIG. 2G. FIG. 2G is an operational timing sequences of the organic light-emitting diode circuit 200 illustrated in FIG. 2F.

As shown in FIG. 2F and FIG. 2G, the organic light-emitting diode circuit 200 is operated under an operational state (e.g., radiating state) during the period O, both the voltage level of the scan signal Sn and the voltage level of the scan signal Sn-1 are low levels so that the transistors M3, M4 are at the off state. When the voltage level of the light-emitting signal EM is converted from the low level into the high level, the transistor M2 is turned on according to the light-emitting signal EM. The driving current Is generated by the second end of the transistor M1 flows into the organic light-emitting diode Oled through the transistor M2 so that the organic light-emitting diode Oled emits light.

In this embodiment, the driving current Is generated by the second end of the transistor M1 can be derived from the following formula (8):

$$\begin{aligned} Is &= 1/2K(Vgs - Vth)^2 \quad (8.) \\ &= 1/2K\left((VDH - VDL) \times \frac{C2}{C1 + Cgd} + Vth + |Verr2| - Vth\right)^2 \\ &= 1/2K\left((VDH - VDL) \times \frac{C2}{C1 + Cgd} + |Verr2|\right)^2 \end{aligned}$$

Wherein K is a constant. Therefore, from the above formulas, it is known that the driving current Is of the organic light-emitting diode Oled will not be affected by the threshold voltage Vth of the transistor M1. That is, even if the threshold voltage Vth of the transistor M1 differs due to variations of the manufacturing process, the luminance of the organic light-emitting diode will be the same.

In this way, the organic light-emitting diode circuit can be applied to the organic light-emitting diode displays. Since the capacitor varies on a basis of the threshold voltage of the transistor, and the threshold voltage of the transistor during each frame period are similar to each other, therefore, under the compensation operations, the variations of the voltages stored in the capacitor are similar to or equal to the threshold voltage of the transistor, thus reducing the charging time of the capacitor, and improving the insufficient charge of the capacitor. In this way, the organic light-emitting diode circuit can restrain the variation of the driving current in a short space of time while the problems of the mura of the display may be resolved.

According to an embodiment of the present disclosure, a driving method of an organic light-emitting diode circuit is disclosed. The driving method can be applied to the organic light-emitting diode circuit the same as or similar to the organic light-emitting diode circuit 200 in the aforementioned FIG. 2A, further descriptions are omitted here for the sake of the brevity. The driving method includes the following steps. For illustrative purposes, the following method is using the exemplary embodiments illustrated in, but not limited to, FIG. 2B, FIG. 2C, FIG. 2D, FIG. 2E and FIG. 2F, as embodiments.

Firstly, as shown in FIG. 2B and FIG. 2G, the coupling unit 211 is charged with the control signal Rn-1 during the period I to control the voltage level at the second end of the transistor M1.

In an embodiment, during the period I the driving method further includes the following steps: providing the control signal Rn-1 with a first level to the coupling unit 211; providing the scan signal Sn-1 with a second level to the reset unit 205; providing the scan signal Sn with the second level to the input unit 207; and converting the light-emitting signal EM with a first level into the light-emitting signal EM with a second level, and providing the light-emitting signal EM with the second level to the switch unit 203, wherein the first level differs from the second level.

It is noted that, the high level and the low level as shown in FIG. 2G can be used to represent the first level and the second level described herein and below, however, it is not meant to be a limitation of the present disclosure, people skilled in this art may adjust the definitions of the first level and the second level according to the design requirements.

In this way, the control signal Rn-1 will change the voltage level of the coupling capacitor Cx to thereby change the voltage level at the second end of the transistor M1. Since the detailed operations have been described in the embodiment illustrated in FIG. 2B, further descriptions hence are omitted for the sake of the brevity.

Next, as shown in FIG. 2C and FIG. 2G, the reset unit 205 is driven with the scan signal Sn-1 during the period II to provide the reference voltage Vref to the first end of the capacitor C1.

In an embodiment, during the period III the driving method further includes the following steps: providing a control signal Rn-1 with a first level to the coupling unit 211; switching the scan signal Sn-1 with a second level to the scan signal Sn-1 with a first level, and providing the scan signal Sn-1 with the first level to the reset unit 205; providing the scan signal Sn with the second level to the input unit 207; and providing the light-emitting signal EM with the second level to the switch unit 203.

In this way, the voltage level at the first end of the capacitor can be made as the reference voltage Vref according to the scan signal Sn-1. Since the detailed operations have been described in the exemplary embodiment illustrated in FIG. 2C, further descriptions hence are omit for the sake of the brevity.

Next, as shown in FIG. 2D and FIG. 2G, the input unit 207 is driven with the scan signal Sn to provide a data voltage Vdata to the first end of the second capacitor C1 during the period III, wherein the voltage level of the data voltage Vdata is a low level.

In an embodiment, during the period III the driving method further includes the following steps: switching the control signal Rn-1 with a first level into the control signal Rn-1 with a second level, and providing the control signal Rn-1 with the second level to the coupling unit 211; switching the scan signal Sn-1 with a first level into the scan signal Sn-1 with a second level and providing the scan signal Sn-1 with the second level to the reset unit 207; switching the scan signal Sn with the second level to the scan signal Sn with the first level and providing the scan signal Sn with the first level to the input unit 207; and providing the light-emitting signal EM with the second level to the switch unit 203.

In this way, the voltage level at the first end of the capacitor C1 is the data voltage Vdata with a low level according to the scan signal Sn. Since the detailed operations have been described in the embodiment illustrated in FIG. 2D, further descriptions hence are omitted for the sake of the brevity.

Then, as shown in FIG. 2E and FIG. 2G, the input unit 207 is driven with the scan signal Sn during the period IV to provide the data voltage Vdata with the high level to the first end of the capacitor C1.

In an embodiment, during the period IV the driving method further includes the following steps: providing the control signal Rn-1 with the second level to the coupling unit 211; providing the scan signal Sn-1 with the second level to the reset unit 205; switching the scan signal Sn with the first level into the scan signal Sn with the second level and providing the scan signal Sn with the second level to the input unit 207; and providing the light-emitting signal EM with the second level to the switch unit 203.

In this way, the voltage level at the first end of the capacitor C1 is the data voltage Vdata with a high level according to the scan signal Sn. Since the detailed operations have been described in the exemplary embodiment illustrated in FIG. 2E, further descriptions hence are omitted for the sake of the brevity.

Finally, as shown in FIG. 2F and FIG. 2G, the switch unit 203 is driven with the light-emitting signal EM during the period O so that the driving current Is flows into the organic light-emitting diode Oled through the switch unit 203.

In an embodiment, as shown in FIG. 2F and FIG. 2G, during the period O the driving method further includes the following steps: providing the control signal Rn-1 with the second level to the coupling unit 211; providing the scan signal Sn-1 with the second level to the reset unit 205; providing the scan signal Sn with the second level to the input unit 207; and switching the light-emitting signal EM with the second level into the light-emitting signal EM with the first level and providing the light-emitting signal EM with the first level to the switch unit 203.

In this way, the driving current Is of the organic light-emitting diode Oled is not affected by the threshold voltage Vth of the transistor M1. Since the detailed operations have been described in the exemplary embodiment illustrated in FIG. 2F, further descriptions hence are omitted for the sake of the brevity.

Therefore, by applying the aforementioned embodiments, the organic light-emitting diode circuit and the driving method make the driving current which drives the organic light-emitting diode would not change along with the variations of the threshold voltage of the transistor, and dynamically adjust the reset voltage so that the voltage difference between the reset voltage and the threshold voltage is fixed, to reduce the deviation value under the same period of time, and improve the insufficient charge of the capacitor. In addition, the organic light-emitting diode circuit can restrain the variation of the driving current in a short space of time while the problems of the mura of the display may be resolved.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An organic light-emitting diode circuit, comprising:

a storage unit comprising a first capacitor, wherein the first capacitor comprises a first end and a second end;

a first transistor comprising a first end, a second end, and a control end, the control end of the first transistor directly connected to the first end of the first capacitor, and the first transistor configured to be driven by a voltage stored in the storage unit to generate a driving current from the second end of the first transistor;

a coupling capacitor comprising a first end electrically coupled to the second end of the first transistor and a second end, and the coupling capacitor configured to change a voltage of the second end of the first transistor from a first voltage level to a second voltage level according to a voltage variation of the second end of the coupling capacitor and the first voltage level of the second end of the first transistor;

a compensation unit comprising a fourth transistor, the fourth transistor comprising a first end, a second end and a control end, the first end of the fourth transistor is directly connected to the second end of the first capacitor, the second end of the fourth transistor is directly connected to the second end of the first transistor, and the compensation unit configured to change the voltage of the second end of the first transistor from the second voltage level to a third voltage level according to a current path, wherein the current path connects the first transistor and the compensation unit in series, and the current path is activated by a first scan signal;

an input unit configured to transmit a data voltage to the storage unit according to a second scan signal;

an organic light-emitting diode configured to receive the driving current; and a switch unit configured to be turned on according to a light-emitting signal so that the driving current is transmitted to the organic light-emitting diode through the switch unit.

2. The organic light-emitting diode circuit of claim 1, wherein the storage unit further comprises a second capacitor, the second capacitor comprises a first end and a second end, the second end of the first capacitor is directly connected to the first end of the second capacitor, and the second end of the second capacitor is electrically coupled to the switch unit.

3. The organic light-emitting diode circuit of claim 2, wherein the first capacitor is configured to store a threshold voltage of the first transistor, and the second capacitor is configured to store the data voltage.

4. The organic light-emitting diode circuit of claim 2, wherein the first end of the first transistor is configured to receive a voltage source, and the second end of the first transistor is electrically coupled to the switch unit.

5. The organic light-emitting diode circuit of claim 2, wherein the switch unit comprises a second transistor comprising a first end, a second end, and a control end, wherein the first end of the second transistor is electrically coupled to the first transistor, the control end of the second transistor is configured to receive the light-emitting signal, and the second end of the second transistor is electrically coupled to the organic light-emitting diode; and the coupling capacitor is electrically coupled between the first end of the second transistor and the control end of the second transistor, and a difference between the first voltage level and the second voltage level is generated according to the light-emitting signal being divided by the coupling capacitor and the first capacitor.

6. The organic light-emitting diode circuit of claim 2, further comprising: a first reset unit, wherein the first reset unit comprises a third transistor that comprises a first end, a second end, and a control end, wherein the first end of the third transistor is electrically coupled to a reference voltage, the control end of the third transistor is configured to receive the first scan signal, and the second end of the third transistor is electrically coupled to the first transistor and the first capacitor.

7. The organic light-emitting diode circuit of claim 2, wherein the first end of the fourth transistor is further electrically coupled to the first end of the second capacitor, the second end of the fourth transistor is further electrically coupled to the switch unit and a coupling capacitor, and the control end of the fourth transistor is configured to receive the first scan signal.

8. The organic light-emitting diode circuit of claim 2, wherein the input unit comprises a fifth transistor comprising a first end, a second end, and a control end, wherein the first end of the fifth transistor is configured to receive the data voltage, the control end of the fifth transistor is configured to receive the second scan signal, and the second end of the fifth transistor is directly connected to the second end of the first capacitor and the first end of the second capacitor; and the organic light-emitting diode circuit further comprises a second reset unit that comprises a sixth transistor, wherein the sixth transistor has a first end, a second end, and a control end, the first end of the sixth transistor is electrically coupled to a reference voltage, the control end of the sixth transistor is configured to the second scan signal, and the second end of the sixth transistor is electrically coupled to the second end of the second capacitor.

9. A driving method of an organic light-emitting diode circuit, applied to an organic light-emitting diode circuit comprising a storage unit which comprises a first capacitor and a second capacitor electrically coupled to each other, a first transistor, wherein a control end of the first transistor is directly connected to a first end of the first capacitor, a coupling capacitor electrically coupled to the first transistor, a compensation unit comprising a fourth transistor, an input unit electrically coupled to the first capacitor and the second capacitor, and an organic light-emitting diode electrically coupled to the second capacitor, a first end of the fourth transistor is directly connected to a second end of the first capacitor, a second end of the fourth transistor is directly connected to a second end of the first transistor and the coupling capacitor, the driving method comprising:

during a second period, driving a first reset unit and the compensation unit with a first scan signal, providing a reference voltage to the first end of the first capacitor, driving the compensation unit with the first scan signal to conduct the second end of the first transistor to the second end of the first capacitor to change a voltage level at the second end of the first transistor from a first voltage level to a second voltage level according to a voltage variation of the second end of the coupling capacitor and the first voltage level at the second end of the first transistor, and changing the voltage level at the second end of the first transistor from the second voltage level to a third voltage level via a current path, wherein the current path connects the first transistor and the compensation unit in series, and the current path is activated by the first scan signal;

during a third period, driving the input unit by a second scan signal to provide a data voltage to a first end of the second capacitor, and driving a second reset unit with the second scan signal to provide the reference voltage to a second end of the second capacitor; and during a fourth period, driving a switch unit by a light-emitting signal so that a driving current generated by the first transistor flow into the organic light-emitting diode through the switch unit.

10. The driving method of claim 9, further comprising:

during a first period, driving the first reset unit and the compensation unit with the first scan signal, and driving the switch unit by the light-emitting signal, providing the reference voltage to the first end of the first capacitor, turning on the first transistor so that the second end of the first transistor controls the second end of the first capacitor.

11. An organic light-emitting diode circuit, comprising:

a storage unit comprising a first capacitor having a first end and a second end;

a first transistor comprising a control end and a second end, the control end of the first transistor directly connected to the first end of the first capacitor, the second end of the first transistor directly connected to the second end of the first capacitor, and the first transistor configured to be driven by a voltages stored in the storage unit to generate a driving current from the second end of the first transistor;

a coupling capacitor electrically coupled to the second end of the first transistor and configured to change a voltage level of the second end of the first transistor from a first voltage level to a second voltage level according to a voltage variation of a control signal and the second end of the first transistor;

an input unit configured to transmit a data voltage to the storage unit according to a second scan signal;

an organic light-emitting diode configured to receive the driving current; and a switch unit, the switch unit comprising a second transistor, the second transistor comprising a first end, a second end, and a control end, wherein the first end of the second transistor is directly connected to the second end of the first capacitor, the control end of the second transistor is configured to receive a light-emitting signal, and the second end of the second transistor is electrically coupled to the organic light-emitting diode.

12. The organic light-emitting diode circuit of claim 11, wherein the second end of the first capacitor electrically connects to the switch unit; and the first transistor further comprises a first end, wherein the first end of the first transistor is configured to receive a voltage source.

13. The organic light-emitting diode circuit of claim 11, wherein the coupling capacitor comprises a first end and a second end, wherein the first end of the coupling capacitor is directly connected to the second end of the first capacitor, and the second end of the coupling capacitor is configured to receive the control signal; and the input unit comprises a fourth transistor, the fourth transistor comprises a first end, a second end, and a control end, the first end of the fourth transistor is configured to receive the data voltage, the control end of the fourth transistor is configured to receive the second scan signal, and the second end of the fourth transistor is electrically coupled to the first end of the first capacitor.

14. A driving method of an organic light-emitting diode circuit, applied to an organic light-emitting diode circuit, comprising a storage unit having a first capacitor, a first transistor electrically coupled to the first capacitor, a coupling unit electrically coupled to the first transistor, an input unit electrically coupled to the first transistor, and an organic light-emitting diode which is configured to receive a driving current provided by the first transistor, and a switch unit, wherein the first transistor comprises a control end, a first end and a second end, the control end of the first transistor is directly connected to a first end of the first capacitor, the second end of the first transistor is directly connected to a second end of the first capacitor, the switch unit comprising a second transistor, a first end of the second transistor is directly connected to the second end of the first capacitor, a second end of the second transistor is electrically coupled to the organic light-emitting diode, the driving method comprises:

during a first period, charging the coupling unit with a control signal to control a voltage level at the second end of the first transistor;

during a second period, driving a first reset unit with a first scan signal to provide a reference voltage to the first end of the first capacitor;

during a third period, driving the input unit with a second scan signal to provide a data voltage to the first end of the first capacitor;

during a fourth period, driving the input unit with the second scan signal to provide the data voltage with a high level to the first end of the first capacitor; and during a fifth period, driving the switch unit with a light-emitting signal so that the driving current flows into the organic light-emitting diode through the switch unit.

15. The driving method of claim 14, wherein during the first period the driving method further comprises:

providing the control signal with a first level to the coupling unit;

providing the first scan signal with a second level to the first reset unit;

providing the second scan signal with the second level to the input unit; and switching from the light-emitting signal with the first level into the light-emitting signal with the second level and providing the light-emitting signal with the second level to the switch unit, wherein the first level is different from the second level.

16. The driving method of claim 15, wherein during the second period the driving method further comprises:

providing the control signal with the first level to the coupling unit;

switching from the first scan signal with the second level into the first scan signal with the first level and providing the first scan signal with the first level to the first reset unit;

providing the second scan signal with the second level to the input unit; and providing the light-emitting signal with the second level to the switch unit.

17. The driving method of claim 16, wherein during the third period the driving method further comprises:

switching from the control signal with the first level into the control signal with the second level, and providing the control signal with the second level to the coupling unit;

switching from the first scan signal with the first level into the first scan signal with the second level and providing the first scan signal with the second level to the first reset unit;

switching from the second scan signal with the second level into the second scan signal with the first level and providing the second scan signal with the first level to the input unit; and providing the light-emitting signal with the second level to the switch unit.

18. The driving method of claim 17, wherein during the fourth period the driving method further comprises:

providing the control signal with the second level to the coupling unit;

providing the first scan signal with the second level to the first reset unit;

switching from the second scan signal with the first level into the second scan signal with the second level and providing the second scan signal with the second level to the input unit; and providing the light-emitting signal with the second level to the switch unit.

19. The driving method of claim 18, wherein during the fifth period the driving method further comprises:

providing the control signal with the second level to the coupling unit;

providing the first scan signal with the second level to the first reset unit;

providing the second scan signal with the second level to the input unit; and switching from the light-emitting signal with the second level into the light-emitting signal with the first level and providing the light-emitting signal with the first level to the switch unit.

20. The organic light-emitting diode circuit of claim 11, wherein the coupling capacitor comprises a first end and a second end, wherein the first end of the coupling capacitor is directly connected to the second end of the first capacitor, and the second end of the coupling capacitor is configured to receive the control signal; and the organic light-emitting diode circuit further comprises a first reset unit, the first reset unit comprising a third transistor that has a first end, a second end and a control end, wherein the first end of the third transistor is electrically coupled to the first end of the first capacitor, the control end of the third transistor is configured to receive a first scan signal, and the second end of the third transistor is configured to receive a reference voltage.

* * * * *